US006481335B2

(12) United States Patent
Shteynberg

(10) Patent No.: US 6,481,335 B2
(45) Date of Patent: Nov. 19, 2002

(54) HYBRID ACTUATOR

(76) Inventor: Mark Y. Shteynberg, P.O. Box 356, Lynnwood, WA (US) 98046-0356

( * ) Notice: Subject to any disclaimer, the term of this patent is extended or adjusted under 35 U.S.C. 154(b) by 0 days.

(21) Appl. No.: 09/470,733

(22) Filed: Dec. 23, 1999

(65) Prior Publication Data

US 2002/0056360 A1 May 16, 2002

(51) Int. Cl.[7] ..... F15B 15/22
(52) U.S. Cl. ..... 92/143
(58) Field of Search ..... 92/82, 114, 145

(56) References Cited

U.S. PATENT DOCUMENTS

| | | | | | |
|---|---|---|---|---|---|
| 2,624,318 | A | | 1/1953 | Walder | 121/45 |
| 3,146,680 | A | | 9/1964 | Hutter | 92/12 |
| 3,176,801 | A | * | 4/1965 | Huff | 92/9 |
| 3,313,214 | A | | 4/1967 | Ackerman | 92/8 |
| 3,678,805 | A | | 7/1972 | Weyman | 92/11 |
| 4,526,088 | A | * | 7/1985 | Reuschenbach et al. | 92/143 |
| 5,735,187 | A | | 4/1998 | Harju | 91/44 |

OTHER PUBLICATIONS

Catalog No. 147 pp. 39–49, Jan. 1996, Allenair Corp. 255East Second Street Mineola, NY 11501.

* cited by examiner

*Primary Examiner*—F. Daniel Lopez
*Assistant Examiner*—Thomas E. Lazo

(57) ABSTRACT

A hybrid of the pneumatic and hydraulic actuators for combining pneumatically powered actuation with incompressible and controllable hydraulic damping in order to achieve smooth displacement, rapid stopping and steady and accurate positioning of the hybrid actuator in which hydraulic damping of a pneumatic actuator is obtained through utilizing positive-displacement hydraulic actuator means with zero volumetric differential.

7 Claims, 10 Drawing Sheets

3
117
108
159
111
114
129
123
156
51
27
24i
153

132c
132a
120a
132b
120b
132d
15
126
150
147
144
141

HYBRID ACTUATOR

BACKGROUND OF THE INVENTION

The present invention relates to hybrid devices of the pneumatic and positive-displacement hydraulic actuators generally named "hydropneumatic actuator". A hydropneumatic actuator per the present invention has a broad spectrum of applications in many industrial fields, and can be used for actuating a variety of machine parts and objects. More particularly, this invention relates to improvements in pneumatic actuators utilizing positive-displacement zero volumetric differential hydraulic dampening means for achieving smooth displacement, rapid stopping and steady, and accurate positioning of the actuator.

Pneumatic actuators (piston-cylinders, rotary actuators, etc.) are generally advantageous in respect to low purchase and operation cost over positive-displacement hydraulic actuators. The simplicity of using one centralized station producing compressed air (which in some instances is capable of supplying a whole plant with air power), cheap of-the-shelf pneumatic hardware and means of control (such as hoses, fittings, switches, valves, etc.) makes pneumatics almost a plug-in technology.

Pneumatic actuators, however, have certain disadvantages. For example, they suffer rapid accelerations (which normally happens at the beginning of actuation) and "creeping" (when the compressed air is cut off, but the actuator keeps moving). These effects are attributed to the compressibility of air. Using pneumatic actuators it is very difficult to achieve accurate control of speed and displacement, or maintain a steady position of an actuator. In fact, achieving the quality of motion and position control equivalent or even any close to the quality of motion and position control routinely achievable by positive-displacement hydraulic systems is practically unrealistic.

Positive-displacement hydraulic actuators, on the other hand, offer an excellent motion and position control, but the cost of hydraulic systems as well as the maintenance of hydraulics is high. In addition, most hydraulic systems require individual pump stations, which makes them even more expensive and further complicates the their usage.

The present invention offers an inexpensive hybrid actuator that allows to combine the advantages of the pneumatic and positive-displacement hydraulic actuation. The present invention gives a viable alternative to those areas of the industry where the need in accurate control of motion and position is contradicted by a low cost requirement.

It is known in the art to utilize positive-displacement hydraulic actuators in combination with pneumatic actuators. In such hybrids a displacement that takes place in a pneumatic actuator is being translated into a displacement of a positive-displacement hydraulic actuator filled with dampening fluid, thus causing a flow of dampening fluid in the hydraulic actuator. The accurate control of motion and position is then achieved through controlling the flow of dampening fluid using a variety of optional valve means and their combinations.

U.S. Pat. No. 2,624,318 to B. Walder, et. al. shows a pneumatic cylinder with a hollow piston rod serving as a housing unit for a hydraulic actuator containing dampening fluid which travels from one side of the hydraulic actuator plunger to the other.

This invention uses a single rod hydraulic actuator for dampening the pneumatic cylinder. The obvious disadvantage of such an arrangement is the presence of a volumetric differential in the dampening cylinder (that is natural for single rod hydraulic actuators). To compensate for the volumetric differential of the dampening hydraulic actuator the device is equipped with an additional expendable reservoir for receiving, containing and returning back to the system differential volumes of dampening fluid.

U.S. Pat. No. 3,146,680 to James F. Hutter, et. al. shows a hydraulically controlled pneumatic cylinder with a hollow piston rod utilized as the housing unit of a single rod hydraulic actuator. The hollow piston rod of the pneumatic cylinder is filled with oil. The two chambers of the hydraulic actuator are connected through an oil reservoir with a floating cover and a valve means that allow to control the oil flow between the two chambers of the cylinder.

Similar to the first prior art described, this invention uses a single rod hydraulic actuator (with a natural volumetric differential), and an expandable oil reservoir to compensate for the volumetric differential of the hydraulic actuator.

The expandable reservoirs used in both cases are in essence a form of a hydraulic accumulator means and, thus, are equipped with some type of a built-in spring (mechanical, pneumatic, etc.) that makes them expandable. At the same time, the built-in spring reintroduces the main disadvantage of a true pneumatic actuator—compressibility of the media. Therefore, the utilization of expandable reservoirs defeats the very object or minimizes the extent of improvement attempted by the prior arts described above.

In addition, the complex switches and valve means utilized to control the fluid transfer between the chambers of the hydraulic actuator and through the expandable reservoirs complicate such hybrid actuators, making them more expensive, and less reliable U.S. Pat. No. 3,313,214 to Nathan Ackerman shows a hydropneumatic feed—a hydrid of pneumatic and single rod hydraulic cylinders. This hydropneumatic feed also includes a spring-loaded fluid reservoir of an expandable nature so to compensate for the volumetric differential of the single rod hydraulic cylinder, which is built into a piston rod of the pneumatic cylinder. Therefore, this hydrid shall suffer the same disadvantages as the prior arts discussed above.

U.S. Pat. No. 3,678,805 to Henry Walter Weyman shows a pneumatic cylinder assembly incorporated with single rod hydraulic dampening. In this invention a built-in spring-loaded fluid reservoir of an expandable nature is also used to compensate for the volumetric differential of the single rod dampening hydraulic cylinder.

U.S. Pat. No. 5,735,187 to Bert Harju shows a pneumatic cylinder with an integrated hydraulic control system and a single rod hydraulic dampening cylinder. The arrangement of this invention does not show any special means to compensate for the volumetric differential natural to a single rod hydraulic cylinder. Thus, in order for the hybrid cylinder to be functional the single rod hydraulic actuator shall be partially filled with dampening fluid. In fact, the total volume of the dampening hydraulic fluid shall be no greater than the full volume of the small chamber of the single rod hydraulic dampening cylinder. Therefore, the larger chamber of the hydraulic actuator per this invention will develop a vacuum gauge pressure at all positions of the plunger except the terminal position at which the plunger is fully retracted. Due to the presence of a vacuum gauge pressure in one of the chambers the arrangement of this invention will suffer the same disadvantage of media compressibility as all the prior arts discussed above.

The concept of a hybrid of positive-displacement hydraulic and pneumatic actuators was practically utilized in commercially available devices named "Cyl-Check" by Allenair Corporation. The "Cyl-Check" design arrangement, however, uses single rod hydraulic dampening cylinders and spring-loaded fluid reservoirs as well, to compensate for a volumetric differential of the single rod dampening hydraulic actuators.

Whatever the precise merits, features and advantages of the above cited references, all of them suffer the same main disadvantage attributed to the use of dampening hydraulic actuators with positive volumetric differential. Thus, none of them achieve or fulfill the goal of providing an inexpensive technology which combines the advantages separately inherent to pneumatic and positive-displacement hydraulic actuation.

SUMMARY OF THE INVENTION

It is therefore, a principle object of the present invention to provide a hydropneumatic actuator capable of smooth actuation which speed and positioning can be controlled with high level of accuracy.

Another object of the present invention is to provide a free of "creeping" and rapid speed changes hydropneumatic actuator powered by compressed gasses and yet.

It is also an object of the present invention to provide an inexpensive and reliable hydropneumatic actuator.

Yet another object of the present invention is to provide a hydropneumatic actuator capable of rapid and accurate stops in any required position.

The present invention achieves the forgoing objectives by the use of pneumatic actuators combined with a positive-displacement hydraulic dampening means with zero volumetric differential (such as double rod hydraulic actuators with constant diameter of the rod on both sides of the piston, bellows with equal volumetric to linear displacement ratios, etc.) which allows dampening fluid transfer between its chambers without producing vacuum as well as excessive amounts of dampening fluid (that would require additional spring-loaded fluid reservoirs of an expandable nature).

Such hydropneumatic actuators are simple by design, and inexpensive due to the small number of components from which they can be constructed. The majority the components can be mass produced or off-the-shelf items.

Further objects and advantages of this invention will become apparent from the consideration of the drawings and ensuing description.

DETAILED DESCRIPTION OF THE PREFERRED EMBODIMENTS

Figures 1A, 1B:
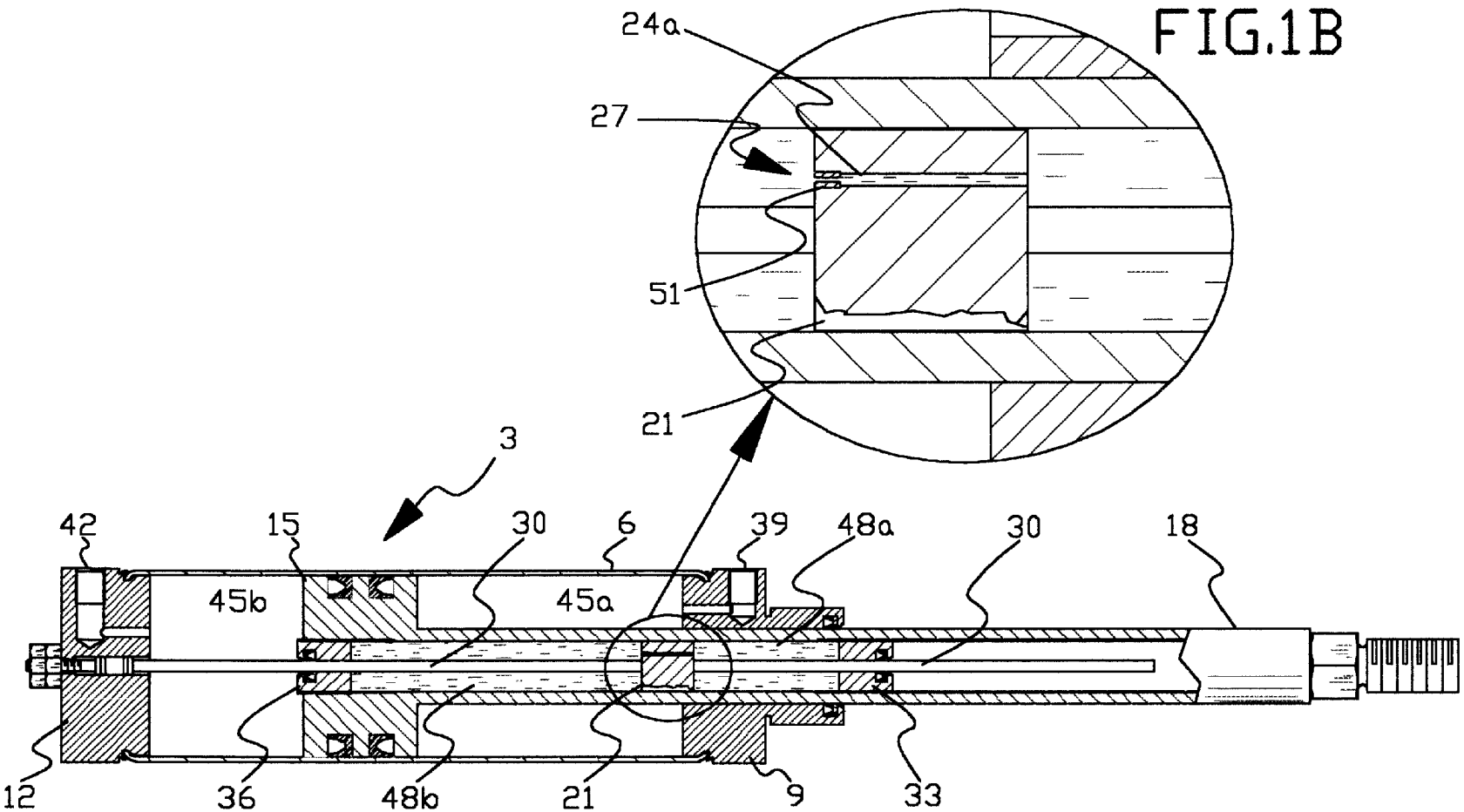
FIG. 1*a* shows a longitudinal sectional view of a hydropneumatic actuator according to a first embodiment of the present invention.
FIG. 1*b* shows a partial enlarged view (of the area encircled on FIG. 1*a*) of the first embodiment of the present invention.

FIG. 1*a* and FIG. 1*b* show a longitudinal sectional view of a hydropneumatic actuator according the first embodiment of the present invention and a partial enlarged sectional view of the circled area on the same sectional view.

The hydropneumatic actuator shown on FIG. 1*a* and FIG. 1*b* is generally constructed of a pneumatic actuator 3 (which according to the first embodiment of the present invention is presented by a pneumatic cylinder), a positivedisplacement hydraulic actuator (which according to the first embodiment of the present invention is presented by a hydraulic actuator built into the pneumatic actuator 3) in the following referred to as "hydraulic actuator", a dampening fluid path 24*a* (shown on FIG. 1*b*), and a dampening fluid flow governor means 27 (shown on FIG. 1*b*).

The pneumatic actuator 3 is further comprised of a pneumatic actuator housing unit, composed of a hollow cylindrical body 6, a front closure 9, fixedly mounted at the front end of the hollow cylindrical body 6, a rear closure 12, fixedly mounted at the rear end of the hollow cylindrical body 6, and a pneumatic actuator actuation means 15 (which according the first embodiment of the present invention is presented by a cylindrical plunger formed with a rod 18) slidably disposed inside the hollow cylindrical body 6.

The pneumatic actuator actuation means 15 divides the active volume of the chamber inside the hollow cylindrical body 6 into two chambers: chamber 45*a* and chamber 45*b*.

The front closure 9 is formed with an air channel 39. The rear closure 12 is formed with an air channel 42. Through the air channels 39 and 42 compressed air can be provided to the chambers 45*a* and 45*b* respectively, to power the pneumatic actuator actuation means 15.

The rod 18 of the pneumatic actuator 3 is formed hollow with an axial cylindrical bore which allows the rod 18 to serve a function of a body for a hydraulic actuator housing unit.

The hydraulic actuator housing unit further includes a hydraulic actuator front closure 33 (fixedly mounted inside the axial cylindrical bore of the rod 18), and a hydraulic actuator rear closure 36 (fixedly mounted at the rear end of the axial cylindrical bore inside the rod 18).

Thus, the hydraulic actuator housing unit is composed of the hollow rod 18 assembled together with the hydraulic actuator front closure 33 and the hydraulic actuator rear closure 36.

The hydraulic actuator further comprises a hydraulic actuator actuation means 21 which, according to the first embodiment of the present invention, is presented by a cylindrical plunger formed with a double rod 30. The hydraulic actuator actuation means 21 is slidably disposed within the axial cylindrical bore inside the rod 18, whereby, the hydraulic actuator actuation means 21 divides the chamber inside the hollow hydraulic actuator housing unit into a first hydraulic chamber 48*a* and a second hydraulic chamber 48*b*. In the following, the total volume of the first hydraulic chamber and the second hydraulic chamber will be referred to as "active volume" of hydraulic actuator.

The double rod 30 has a constant diameter, which is equal on both sides of the hydraulic actuator actuation means 21. This allows to achieve an equal displacement area of the hydraulic actuator actuation means 21 in both hydraulic chambers, 48*a* and 48*b*, of the hydraulic actuator. The design arrangement such as described provides conditions under which the volume of dampening fluid displaced from one hydraulic chamber of the hydraulic actuator is always equal to the volume of dampening fluid received by the opposite hydraulic chamber of the hydraulic actuator. In the following such conditions will be referred to as "zero volumetric differential".

The front closure 33 and rear closure 36 of the hydraulic actuator are formed with channels (not shown) for filling the active volume of the hydraulic actuator and all the adjacent hydraulic cavities with a suitable dampening fluid. The active volume of the hydraulic actuator and all the adjacent hydraulic cavities are completely filled with dampening fluid and sealed with sealing means (not shown).

Hydropneumatic actuator, in accordance with the first embodiment of this invention, further includes the dampening fluid path 24*a* formed as a bore through the hydraulic actuator actuation means 21 which provides a channel for dampening fluid corresponding between the first and the second hydraulic chambers (48*a* and 48*b* respectively) during the operation of the hydraulic actuator.

Further, hydropneumatic actuator of the first embodiment includes the dampening fluid flow governor means 27 installed in series with the dampening fluid path 24*a* in the way of the flow of dampening fluid corresponding between the hydraulic chambers 48*a* and 48*b* in either direction. The governor means 27 impedes the rate of dampening fluid flow between the chambers 48*a* and 48*b* during hydraulic actuator operation, and thus, provides control over dampening fluid transfer. According to the design arrangement of the first embodiment of the present invention, the function of the dampening fluid flow governor means 27 is carried by a permanent orifice 51 (shown on FIG. 1*b*).

To enable the transfer of the displacement generated by the pneumatic actuator into the displacement of the hydraulic actuator, the pneumatic and the hydraulic actuators of the first embodiment are coupled. In accordance with the first embodiment of this invention the housing unit of the hydraulic actuator housing unit is being coupled with the pneumatic actuator actuating means due to the fact that pneumatic actuator actuation means 15 formed with a rod 18 is hollow and simultaneously serves the function of the body of the hydraulic actuator housing unit. Further, the hydraulic actuator actuating means 21 are being coupled with the pneumatic actuator housing unit through the rear end of the double rod 30 of the hydraulic actuator actuation means 21 being fixedly connected to the rear closure 12 of the pneumatic actuator 3 (for example, by threaded fastener means as shown on FIG. 1*a*). According to the first embodiment, the connection between the double rod 30 and the rear closure 12 is being sealed to prevent leakage of compressed air from the chamber 45*b* of the pneumatic actuator 3.

The type of connection and sealing should not be construed as limitations on the scope of the invention. In fact it is widely optional (for example the sealing can be done with o-rings, air tight clamping means, sealing compounds, or by pressing, swaging, gluing, welding, brazing, etc.).

The front end of the double rod 30 is free to move inside the rod 18 of the pneumatic actuator 3.

When compressed air is let into the channel 39 and further to the chamber 45*a* it causes the pneumatic actuator actuation means 15 to move rearward. Respectively, when compressed air is let into the channel 42 and further to the chamber 45*b* it causes the pneumatic actuator actuation means 15 to move forward. The hollow rod 18, as a solid part of the pneumatic actuator actuation means 15, moves with the pneumatic actuator actuation means 15, and, simultaneously, as a solid part of the hydraulic actuator housing unit makes a displacement with respect to the hydraulic actuator actuation means 21. The hydraulic actuator actuation means 21, being fixedly connected to the rear closure 12 through the double rod 30, therefore, remain stationary with respect to the pneumatic actuator housing unit.

During the displacement of the rod 18 with respect to the hydraulic actuator actuation means 21 the dampening fluid contained in the active volume of the hydraulic actuator is being effectively redistributed between the first and the second hydraulic chambers, 48*a* and 48*b*, of the hydraulic actuator. The dampening fluid transfer occurs through the dampening fluid path 24*a* and the dampening fluid flow governor means 27, whereby dampening of the pneumatic actuator rapid speed changes takes place.

Due to the zero volumetric differential of the hydraulic actuator, the volume of dampening fluid displaced from one of hydraulic chambers (48*a* or 48*b*) and receptively received by the other hydraulic chamber (48*b* or 48*a*) of the hydraulic actuator always remains even. Whereby, the hydropneumatic actuator per the present invention provides hydraulic dampening by a self-contained, completely filled with fluid hydraulic actuator that is inherently free from the compressibility effect, and therefore, simultaneously offers the advantages of creeping free smooth displacement, steady positioning and simplicity of design.

While the above description contains many specificities, these should not be construed as limitations on the scope of this invention, but rather as an exemplification of one preferred embodiment thereof. Many variations are possible even within the scope of the first embodiment general design arrangement. For example, the permanent orifice that performs the function of the dampening fluid flow governor means 27 can be substituted by a combination of a shut-off valve and a permanent orifice, which would allow the hydropneumatic actuator to make sudden and steady stops and high accuracy positioning. Another example would be the utilization of a valve with external analog or digital control of the orifice, in which case an additional speed control would become possible.

Figure 2:
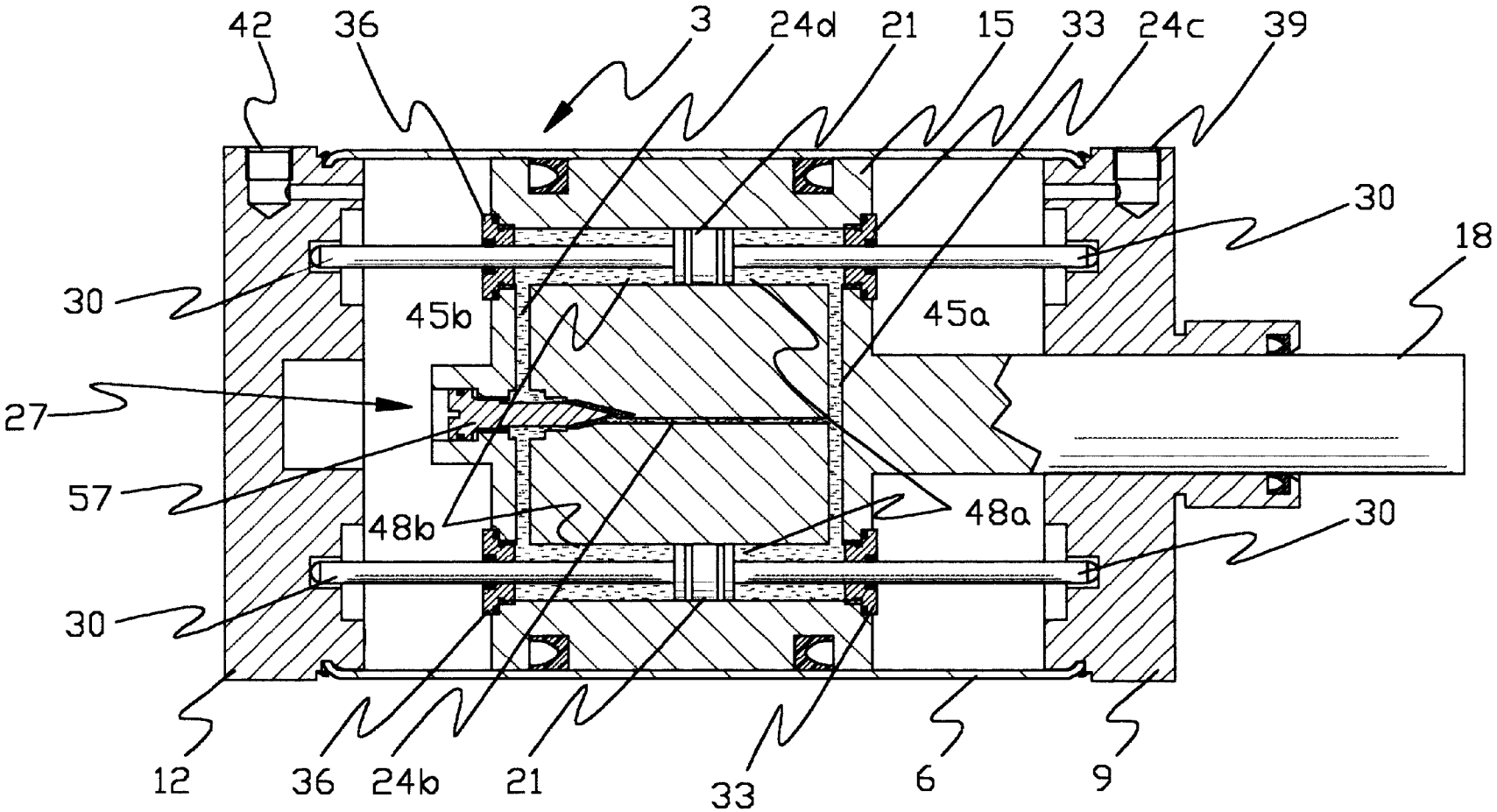
FIG. 2 shows a longitudinal sectional view of a hydropneumatic actuator of a second embodiment according to the present invention.

FIG. 2 shows a longitudinal sectional view of a hydropneumatic actuator according the second embodiment of the present invention.

The hydropneumatic actuator per the second embodiment of the present invention is generally constructed of a pneumatic actuator 3, two positive displacement hydraulic actuators built into pneumatic actuator 3, three dampening fluid paths: 24*b,* 24*c* and 24*d,* and a dampening fluid flow governor means 27.

The pneumatic actuator 3 is further composed of a pneumatic actuator housing unit which comprises a hollow cylindrical body 6, a front closure 9, fixedly mounted at the front end of the hollow cylindrical body 6, a rear closure 12, fixedly mounted at the rear end of the hollow cylindrical body 6, and a pneumatic actuator actuation means 15 (formed as a cylindrical plunger) with a rod 18. The pneumatic actuator actuation means 15 is slidably disposed within the hollow cylindrical body 6 and divides the active volume inside the hollow cylindrical body 6 into two chambers 45*a* and 45*b*.

The front closure 9 is formed with an air channel 39, and the rear closure 12 is formed with an air channel 42. The channels allow compressed air to be provided to the chambers 45*a* and 45*b* respectively to power the pneumatic actuator actuation means 15.

According to the second embodiment the pneumatic actuator actuation means 15 are formed with two cylindrical bores parallel to the main axis of the rod 18, with each bore forming a cylindrical body for one hydraulic actuator.

Each one of the two hydraulic actuators is further comprised of a hydraulic actuator front closure 33 (fixedly mounted at the front end of the cylindrical body inside the pneumatic actuator actuation means 15), and a hydraulic actuator rear closure 36 (fixedly mounted at the rear end of the cylindrical body inside the pneumatic actuator actuation means 15).

The pneumatic actuator actuation means 15, assembled with the two hydraulic actuator front closures 33 and the two hydraulic actuator rear closures 36 composes two hydraulic actuator housing units for two positive displacement hydraulic actuators.

Each one of the two hydraulic actuators further comprises one hydraulic actuator actuation means 21 (which according to the second embodiment of the present invention is presented by a cylindrical plunger formed with a double rod 30) each slidably disposed within one of the two cylindrical bores inside the pneumatic actuator actuation means 15. Each is hydraulic actuator actuation means 21 divides active volume of the hydraulic actuator housing unit it has been placed in into a first hydraulic chamber 48*a* and a second hydraulic chamber 48*b*.

Each double rod 30 has a diameter equal on both sides of the hydraulic actuator actuation means 21, whereby each of the two hydraulic actuators is a zero volumetric differential hydraulic actuator.

The hydraulic actuator closures 33 and 36 are formed with channels (not shown) for filling the total active volume of the two hydraulic actuators and all adjacent hydraulic cavities with a suitable dampening fluid. The first and the second hydraulic chambers 48*a* and 48*b* of each hydraulic actuator and all adjacent hydraulic cavities are completely filled with dampening fluid and sealed with sealing means (not shown).

In accordance with the second embodiment of this invention, the pneumatic actuator actuation means 15 are formed with the three dampening fluid paths 24*b,* 24*c* and 24*d.* The dampening fluid path 24*c* is formed for connecting together the two first hydraulic chambers 48*a* of both hydraulic actuators. The channel 24*d* is formed for connecting together the two second hydraulic chambers 48*b* of both hydraulic actuators. The channel 24*b* is formed for connecting together the two first hydraulic chambers 48*a* with the two second hydraulic chambers 48*b* of both hydraulic actuators.

The pneumatic actuator actuation means 15 further comprises a dampening fluid flow governor means 27 placed in the way of the dampening fluid corresponding between the two first hydraulic chambers 48*a* and the two second hydraulic chambers 48*b*. Per the second embodiment of the present invention, the dampening fluid flow governor means 27 is an adjustable needle valve 57 that allows for fine adjustment to the rate of dampening fluid flow.

Each double rod 30 is fixedly clamped between the front closure 9 and the rear closure 12 of the pneumatic actuator. Thus, both of the hydraulic actuator actuation means remain stationary with respect to the pneumatic actuator housing unit.

When compressed air is let into the channel 39 and further to the chamber 45*a* it causes the pneumatic actuator actuation means 15 to move rearward. Respectively, when compressed air is let into the channel 42 and further to the chamber 45*b* it causes the pneumatic actuator actuation means 15 to move forward. Being at the same time a part of the hydraulic actuator housing unit with movement in either direction, the pneumatic actuator actuation means 15 make a correspondent displacement with respect to the two hydraulic actuator actuation means 21 (which are stationary with respect to the pneumatic actuator housing unit). During this displacement the dampening fluid contained in the active volume of the two hydraulic actuators is being effectively redistributed between the two first and the two second hydraulic chambers, 48*a* and 48*b,* of the hydraulic actuators. The dampening fluid transfer occurs through the dampening fluid paths 24*b,* 24*c* and 24*d,* and the dampening fluid flow governor means 27, whereby dampening of the pneumatic actuator's rapid speed changes takes place.

Due to the zero volumetric differential of the two hydraulic actuators, the volume of dampening fluid displaced by the two first (second) hydraulic chambers 48*a* (48*b*) and receptively received by the two second (first) hydraulic chambers

48*b* (48*a*) of the hydraulic actuators always remains even. Whereby, the hydropneumatic actuator per the second embodiment of the present invention provides hydraulic dampening by a self-contained, completely filled with fluid hydraulic actuator that is inherently free from the compressibility effect and, therefore, offers the advantages of smooth and free of creeping displacement, steady positioning and simplicity of design all at the same time.

Figures 3A, 3B:
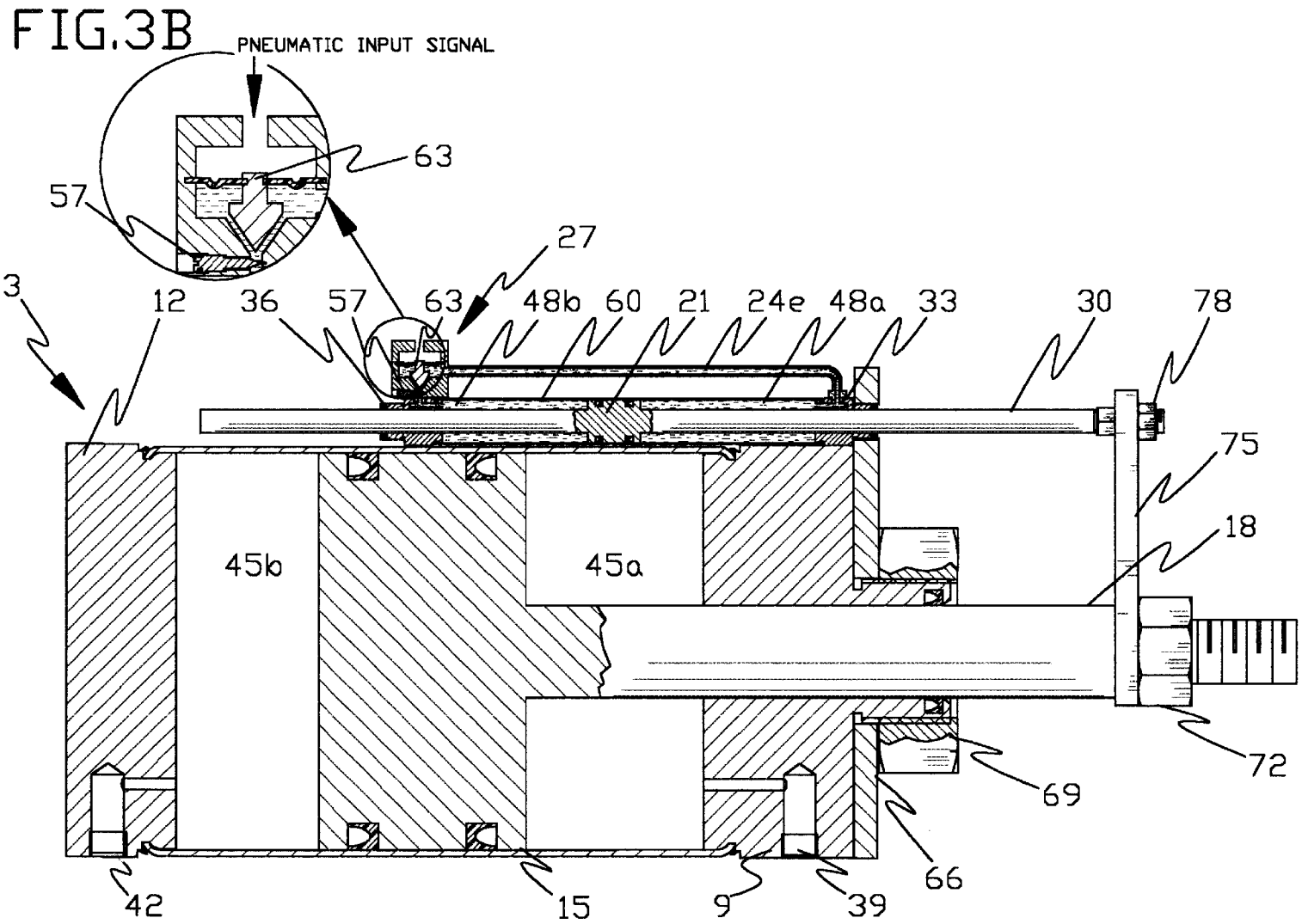
FIG. 3*a* shows a longitudinal sectional view of a hydropneumatic actuator according to a third embodiment of the present invention.
FIG. 3*b* shows a partial enlarged view (of the area encircled on FIG. 3*a*) of the third embodiment of the present invention.

FIG. 3*a* and FIG. 3*b* show a longitudinal sectional view of a hydropneumatic actuator per the third embodiment of the present invention.

The hydropneumatic actuator of the third embodiment is generally comprised of a pneumatic actuator 3, a hydraulic actuator, a dampening fluid path 24*e,* and a dampening fluid flow governor means 27.

The pneumatic actuator 3 is further composed of a pneumatic actuator housing unit that further comprises a hollow cylindrical body 6, a front closure 9, fixedly mounted at the front end of the hollow cylindrical body 6, a rear closure 12, fixedly mounted at the rear end of the hollow cylindrical body 6, and a pneumatic actuator actuation means 15 (formed as a cylindrical plunger) with a rod 18. The pneumatic actuator actuation means 15 are slidably disposed inside the hollow cylindrical body 6 and divide the active volume inside the pneumatic actuator housing unit into chamber 45*a* and chamber 45*b*.

The front closure 9 is formed with an air channel 39, and the rear closure 12 is formed with an air channel 42. Through the channels 39 and 42 compressed air can be provided to the chambers 45*a* and 45*b* respectively, to power the pneumatic actuator actuation means 15.

The hydraulic actuator is further composed of a hydraulic actuator housing unit and a hydraulic actuator actuation means 21 with a double rod 30. The hydraulic actuator housing unit is further comprised of a hollow cylindrical body 60, a front closure 33, fixedly mounted at the front end of the hollow cylindrical body 60, and a rear closure 36, fixedly mounted at the rear end of the hollow cylindrical body 60. The hydraulic actuator actuation means 21 is slidably disposed inside the hollow cylindrical body 60 and divide the active volume of the hydraulic actuator housing unit into a first hydraulic chamber 48*a* and a second hydraulic chamber 48*b*.

The double rod 30 has the same diameter on both sides of the hydraulic actuator actuation means 21, which makes a zero volumetric differential hydraulic actuator.

The hydraulic actuator is mounted alongside the pneumatic actuator 3 with the hydraulic actuator housing unit fixedly clamped to the pneumatic actuator housing unit with a bracket means 66 and a fastener means 69 in a such manner that the main axis of the rod 18 and the main axis the double rod 30 are parallel to each other.

The end of the rod 18 is fixedly connected to the front end of the double rod 30 with a bracket means 75 and threaded fastener means 72 and 78 so to allow only simultaneous linear displacement of both the pneumatic actuator and hydraulic actuator actuation means 15 and the hydraulic actuator actuation means 21.

The dampening fluid path 24*e* is formed with an inlet (not shown) for filling the active volume of the hydraulic actuator and all the adjacent hydraulic cavities with a suitable dampening fluid. The dampening fluid path 24*e* connects the first hydraulic chamber 48*a* with the second hydraulic chamber 48*b*. Both, the first hydraulic chamber 48*a* and the second hydraulic chamber 48*b* and all the adjacent hydraulic cavities are completely filled with dampening fluid and sealed with sealing means (not shown).

The dampening fluid flow governor means 27 is placed in the dampening fluid path 24*e* in the way of the dampening fluid corresponding between the hydraulic chambers 48*a* and 48*b*. Per the third embodiment of the present invention a pneumatically controlled shut-off valve 63 and an adjustable needle valve 57 connected in series carry the function of the dampening fluid flow governor means 27. The shut-off valve is utilized to enable an accurate positioning control in addition to the adjustable dampening provided by the needle valve 57.

Due to the rigid connection between the rod 18 and the double rod 30 the hydraulic actuator actuation means 21 actuates simultaneously with the pneumatic actuator actuation means 15. During actuation the hydraulic actuator actuation means 21 forces the transfer of dampening fluid between the first and second hydraulic chambers 48*a* and 48*b*. The dampening fluid transfer between the chambers 48*a* and 48*b* takes place through the dampening fluid path 24*e* and the dampening fluid flow governor means 27, where hydraulic locking and dampening of the pneumatic actuator 3 effectively occur.

Utilization of the hydraulic actuator with zero volumetric differential allows for hydraulic locking and dampening with a self-contained hydraulic actuator free from the compressibility effect and, thus, offering the advantages of smooth and free of creeping displacement, steady positioning and design simplicity.

Figure 4:
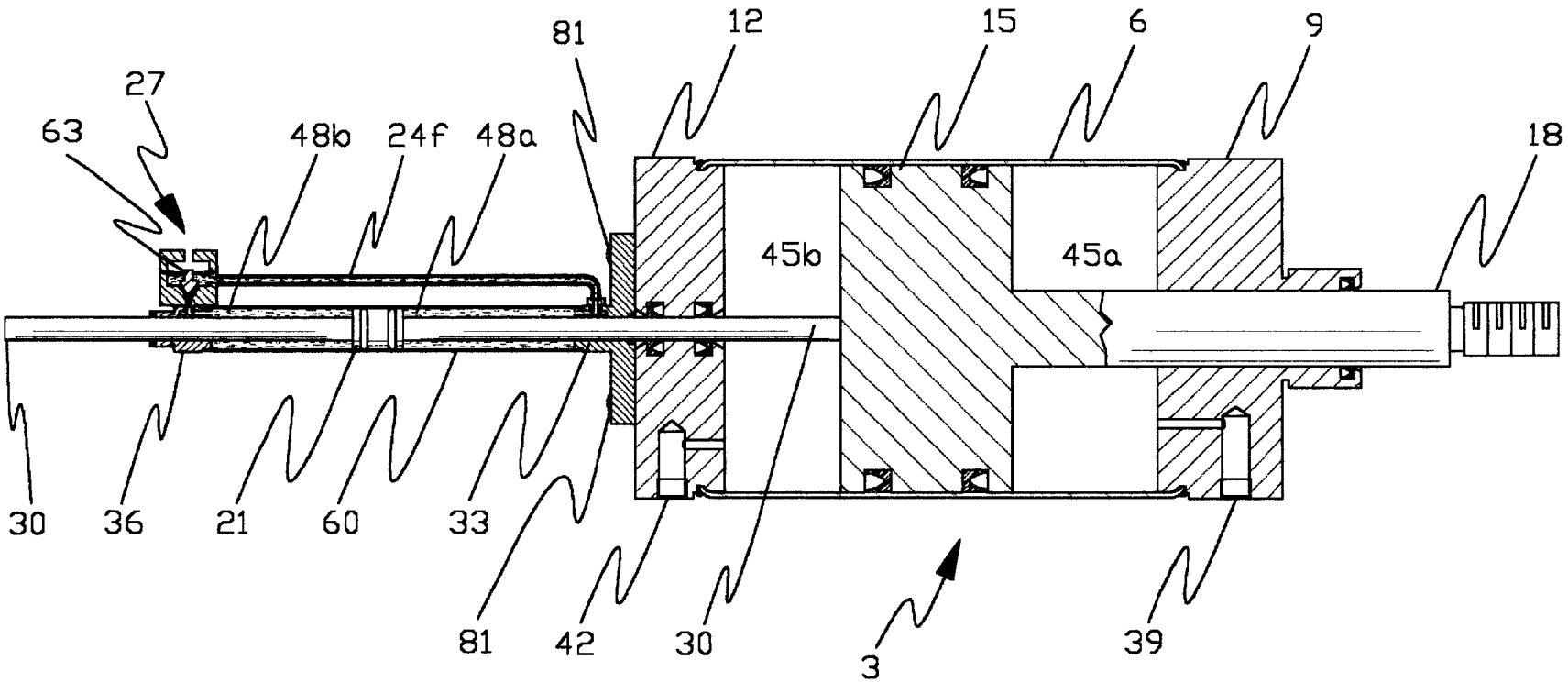
FIG. 4 shows a longitudinal sectional view of a hydropneumatic actuator according to a fourth embodiment of the present invention.

FIG. 4 shows a longitudinal sectional view of a hydropneumatic actuator per the fourth embodiment of the present invention.

The hydropneumatic actuator of the fourth embodiment is generally comprised of a pneumatic actuator 3, a hydraulic actuator, a dampening fluid path 24*f,* and a dampening fluid flow governor means 27.

The pneumatic actuator 3 is further composed of a pneumatic actuator housing unit that comprises a hollow cylindrical body 6, a front closure 9, fixedly mounted at the front end of the hollow cylindrical body 6, a rear closure 12, fixedly mounted at the rear end of the hollow cylindrical body 6, and a pneumatic actuator actuation means 15 (formed as a plunger) with a rod 18. The pneumatic actuator actuation means 15 is slidably disposed inside the hollow cylindrical body 6 and divide the chamber of the pneumatic actuator housing unit into chamber 45*a* and chamber 45*b*.

The front closure 9 is formed with air channel 39, and the rear closure 12 is formed with air channel 42 through which compressed air can be provided to the chambers 45*a* and 45*b* respectively to power the pneumatic actuator actuation means 15.

According to the fourth embodiment of the present invention the hydraulic actuator is mounted externally in line with the pneumatic actuator 3. The hydraulic actuator is further composed of a hydraulic actuator housing unit and a hydraulic actuator actuation means 21 formed with a double rod 30. The hydraulic actuator housing unit is further comprised of a hollow cylindrical body 60, a front closure 33, fixedly mounted at the front end of the hollow cylindrical body 60, and a rear closure 36, fixedly mounted at the rear end of the hollow cylindrical body 60.

The hydraulic actuator actuation means 21 is slidably disposed inside the hollow cylindrical body 60, and divides active volume of the hydraulic actuator into a first hydraulic chamber 48*a* and a second hydraulic chamber 48*b*.

The double rod 30 has a constant diameter equal on both sides of the hydraulic actuator actuation means 21, which makes the hydraulic actuator a zero volumetric differential hydraulic actuator.

The hydraulic actuator front closure 33 is fixedly connected to pneumatic actuator rear closure 12 with a plurality of threaded fastener means 81.

The front end of the double rod 30 of the hydraulic actuator air-tightly extends through the axial hole in the center of the rear closure 12, and fixedly connected to the rear end of the pneumatic actuator actuation means 15 to allow only simultaneous linear displacements of both the pneumatic actuator actuation means 15 and the hydraulic actuator actuation means 21.

This type of connection should not be construed as limitations on the scope of the present invention. In fact, it is widely optional. For example, the connection can be also made by clamping, pressing, swaging, gluing, welding, brazing, using threaded fasteners, etc.

The dampening fluid path 24*f* is formed with an inlet (not shown) for filling the active volume of the hydraulic actuator and all of the adjacent hydraulic cavities with a suitable dampening fluid, and provides a connection between the first hydraulic chamber 48*a* and the second hydraulic chamber 48*b*. Both, the first hydraulic chamber 48*a* and the second hydraulic chamber 48*b* and all adjacent hydraulic cavities are completely filled with dampening fluid and sealed with sealing means (not shown).

The dampening fluid flow governor means 27 is placed in dampening fluid path 24*f* in the way of the dampening fluid corresponding between the hydraulic chambers 48*a* and 48*b*. Per the fourth embodiment of the present invention a pneumatically controlled shut-off valve 63 carries the function of the dampening fluid flow governor means 27. The shut-off valve 63 is utilized to enable accurate positioning control.

Due to the rigid connection between the rod 18 and the double rod 30 the hydraulic actuator actuation means 21 actuate simultaneously with the pneumatic actuator actuation means 15. During actuation the hydraulic actuator actuation means 21 effectively force transfer of the dampening fluid between the first and the second hydraulic chambers 48*a* and 48*b*. The dampening fluid transfer between the chambers 48*a* and 48*b* takes place through the dampening fluid path 24*f* and the dampening fluid flow governor means 27 where hydraulic locking and dampening of the pneumatic actuator 3 effectively occurs.

Utilization of the hydraulic actuator with zero volumetric differential allows for hydraulic locking and dampening with a self-contained hydraulic actuator free from the compressibility effect and, thus, offering the advantages of smooth and free of creeping displacement, steady positioning and design simplicity.

Figure 5:
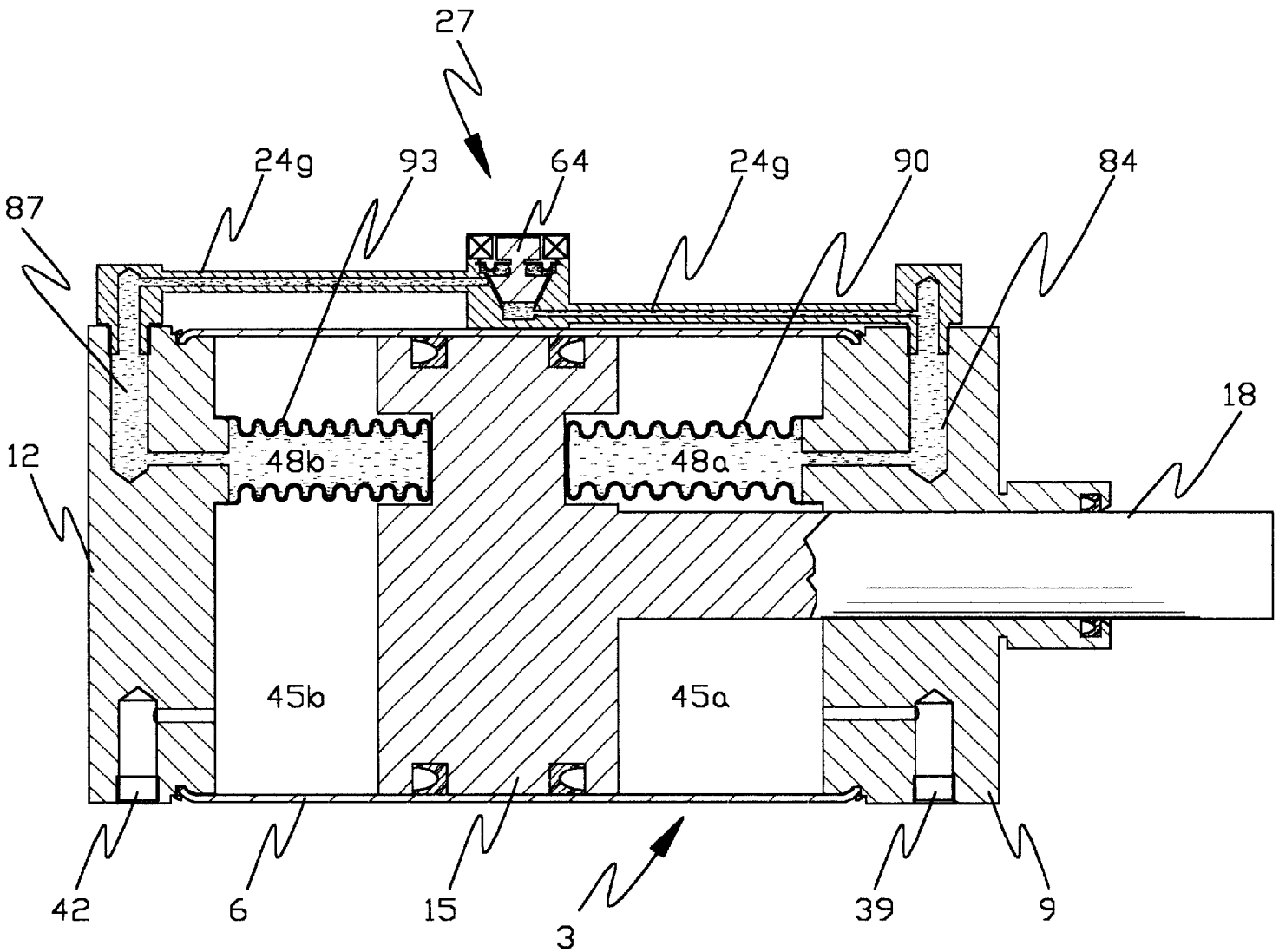
FIG. 5 shows a longitudinal sectional view of a hydropneumatic actuator illustrating a possible design arrangement of positive-displacement hydraulic dampening means according to a fifth embodiment of the present invention.

FIG. 5 shows a longitudinal sectional view of a hydropneumatic actuator per the fifth embodiment of the present invention. As it will become apparent from the ensuing description, in the fifth embodiment of the present invention the function of the positive-displacement dampening hydraulic actuator with zero volumetric differential is carried by a different type of positive-displacement device.

The hydropneumatic actuator per the fifth embodiment is generally comprised of a pneumatic actuator 3, a hydraulic actuator, a dampening fluid path 24*g*, and dampening fluid flow governor means 27.

The pneumatic actuator 3 is further composed of a pneumatic actuator housing unit that is comprised of a hollow cylindrical body 6, a front closure 9 fixedly mounted at the front end of the hollow cylindrical body 6, a rear closure 12 fixedly mounted at the rear end of the hollow cylindrical body 6, and pneumatic actuator actuation means 15 (formed as a cylindrical plunger) with a rod 18. The pneumatic actuator actuation means 15 is slidably disposed inside the hollow cylindrical body 6 and divide the chamber inside the pneumatic actuator housing unit into a chamber 45*a* and a chamber 45*b*.

The front closure 9 is formed with the air channel 39, and the rear closure 12 is formed with the air channel 42. Through the air channels 39 and 42 compressed air can be provided to the chambers 45*a* and 45*b* respectively to actuate the pneumatic actuator actuation means 15.

The front closure 9 is further formed with a first hydraulic channel 84, and the rear closure 12 is further formed with a second hydraulic channel 87. As it will become apparent from the ensuing description, the first and the second hydraulic channels 84 and 87 allow the front and the rear closures 9 and 12 to form a hydraulic actuator housing unit.

The hydraulic actuator comprises the hydraulic actuator housing unit and two hydraulic actuator actuation means 90 and 93. According to the fifth embodiment of the present invention the hydraulic actuator actuation means 90 and 93 are formed of bellows made out of a suitable material (metallic, plastic, composition, etc.) each with one sealed terminal end in contact with the pneumatic actuator actuation means 15 and one open inlet end. The open inlet end of the hydraulic actuator actuation means 90 is air-tightly assembled (for example by gluing, welding, brazing, etc.) to the front closure 9 in such manner that the hydraulic channel 84 is connected to the first hydraulic chamber 48*a* of the hydraulic actuator actuation means 90. The open inlet end of the hydraulic actuator actuation means 93 is air-tightly assembled (for example by gluing, welding, brazing, etc.) to the front closure 12 in such manner that the hydraulic channel 87 is connected to the first hydraulic chamber 48*b* of the hydraulic actuator actuation means 93.

The dampening fluid path 24*g* is formed with an inlet (not shown) for filling the active volume of the hydraulic actuator and all adjacent hydraulic cavities with a suitable dampening fluid. The dampening fluid path 24*g* provides a connection between the first hydraulic chamber 48*a* and the second hydraulic chamber 48*b*. Both, the first hydraulic chamber 48*a* and the second hydraulic chamber 48*b* and all adjacent hydraulic cavities are completely filled with dampening fluid and sealed with sealing means (not shown).

The dampening fluid flow governor means 27 are placed in the middle of the dampening fluid path 24*g* in the way of the dampening fluid corresponding between the first and second hydraulic chambers 48*a* and 48*b*. Per the fifth embodiment of the present invention the dampening fluid flow governor means 27 is an electrically controlled shut-off valve 64, which enables the hydropneumatic actuator of the fifth embodiment to make rapid and accurate stops in any required position.

In order to achieve zero volumetric differential of the hydraulic actuator the hydraulic actuator actuation means 90 and 93 are constructed so to have equal volumetric to linear displacement ratios that can be mathematically described by the following equation:

$$\frac{V_{48a}}{l_{48a}} = \frac{V_{48b}}{l_{48b}}$$

Where:

$V_{48a}$—a volumetric change of the first hydraulic chamber 48*a*;

$l_{48a}$—a linear displacement of the hydraulic actuator actuation means 90;

$V_{48b}$—a volumetric change of the second hydraulic chamber 48*b* associated with the volumetric change $V_{48a}$ of the first hydraulic chamber 48*a*;

$l_{48b}$—a linear displacement of the hydraulic actuator actuation means 93 associated with the linear displacement $l_{48a}$ of the hydraulic actuator actuation means 90.

Both hydraulic actuator actuation means 90 and 93 remain in perpetual contact with the pneumatic actuator actuation means 15.

When the pneumatic actuator actuation means 15 moves forward it compresses the hydraulic actuator actuation means 90, and causes a negative linear displacement $l_{48a}$ of the hydraulic actuator actuation means 90 and a corresponding displacement of dampening fluid from the first hydraulic chamber 48*a*.

The volume of dampening fluid displaced by the first hydraulic chamber 48*a* is equal to the associated volumetric increase $V_{48b}$ of the second hydraulic chamber 48*b* of the hydraulic actuator actuation means 93 due to the intake of the dampening fluid displaced by the first hydraulic chamber 48*a*.

The associated volumetric increase $V_{48b}$ results in the corresponding positive linear displacement $l_{48b}$ of the hydraulic actuator actuation means 93, which, by the absolute value is equal to the absolute value of the original negative linear displacement $l_{48a}$ of the hydraulic actuator actuation means 90.

When the pneumatic actuator actuation means 15 moves rearward it compresses the hydraulic actuator actuation means 93, and causes a negative linear displacement $l_{48b}$ of the hydraulic actuator actuation means 93 and a corresponding displacement of dampening fluid from the second hydraulic chamber 48*b*.

The volume of dampening fluid displaced by the second hydraulic chamber 48*b* is equal to the associated volumetric increase $V_{48a}$ of the first hydraulic chamber 48*a* of the hydraulic actuator actuation means 90 due to the intake of the dampening fluid displaced by the second hydraulic chamber 48*b*.

The associated volumetric increase $V_{48a}$ results in the corresponding positive linear displacement $l_{48a}$ of the hydraulic actuator actuation means 90, which is, by the absolute value, equal to the original negative linear displacement $l_{48b}$ of the hydraulic actuator actuation means 93.

Taking into consideration the above equation, it becomes apparent that with any direction and amount of linear displacement by the pneumatic actuator actuation means 15 the volume of dampening fluid expelled by deflated hydraulic actuator actuation means (90 or 93) will always remain equal to the volume of dampening fluid received by the inflated hydraulic actuator actuation means (93 or 90).

These conditions allow to maintain a volumetric balance of dampening fluid transferred between the first and second hydraulic chambers (48*a* and 48*b*) of the hydraulic actuator, or, in other words, make the hydraulic actuator utilized by the fifth embodiment of this invention a zero volumetric differential hydraulic actuator.

During dampening fluid transfer between the hydraulic chambers 48*a* and 48*b* the hydraulic dampening effectively occurs in the dampening fluid flow governor means 27. The utilization of the hydraulic actuator with zero volumetric differential allows to achieve hydraulic locking and dampening with a self-contained hydraulic actuator that is free from the compressibility effect, and thus, offers the advantages of smooth and free of creeping displacement, steady positioning and design simplicity.

Figures 6A, 6B:
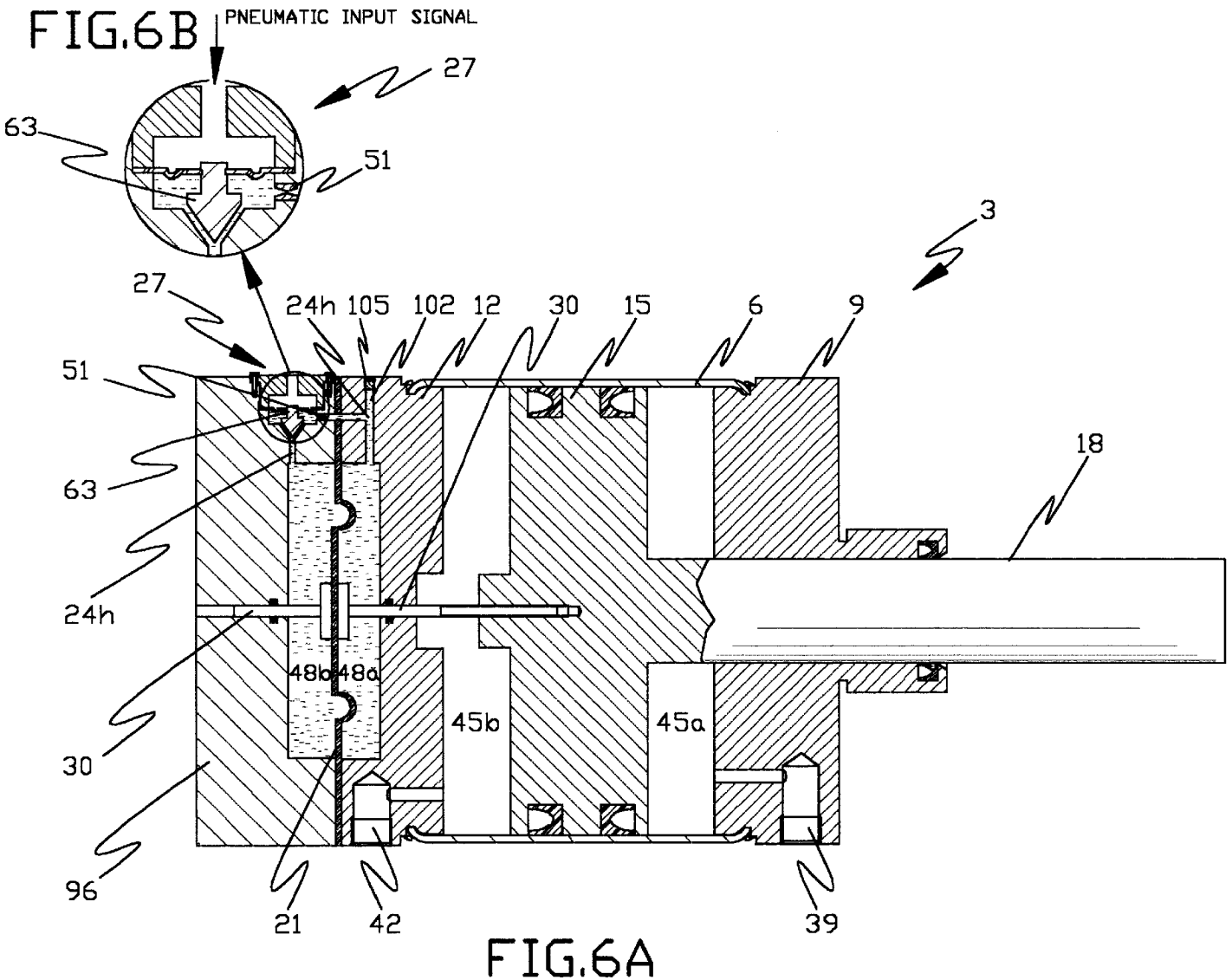
FIG. 6*a* shows a longitudinal sectional view of a hydropneumatic actuator according to a sixth embodiment of the present invention.
FIG. 6*b* shows a partial enlarged view (of the area encircled on FIG. 6*a*) of the sixth embodiment of the present invention.

FIG. 6*a* and FIG. 6*b* show a longitudinal sectional view of a hydropneumatic actuator per the sixth embodiment of the present invention.

The hydropneumatic actuator per the sixth embodiment is generally comprised of a pneumatic actuator 3, a hydraulic actuator, a dampening fluid path 24*h*, and dampening fluid flow governor means 27.

The pneumatic actuator 3 is further composed of a pneumatic actuator actuation means 15 (formed as a cylindrical plunger) with a rod 18, and a pneumatic actuator housing unit that is comprised of a hollow cylindrical body 6, a front closure 9, fixedly mounted at the front end of the hollow cylindrical body 6, a rear closure 12, fixedly mounted at the rear end of the hollow cylindrical body 6. The pneumatic actuator actuation means 15 are slidably disposed inside the hollow cylindrical body 6 and divide the active volume of the chamber inside the pneumatic actuator housing unit into chamber 45*a* and chamber 45*b*.

The front closure 9 is formed with an air channel 39, and the rear closure 12 is formed with an air channel 42. Through the air channels 39 and 42 compressed air can be provided to the chambers 45*a* and 45*b* respectively to power the pneumatic actuator.

The hydraulic actuator comprises a hydraulic actuator housing unit and hydraulic actuator actuation means 21, which according to the sixth embodiment of the present invention, is presented by a thin flexible diaphragm made out of a suitable material (metallic, plastic, composition, etc.) with a detached double rod 30. The double rod 30 of the hydraulic actuator actuation means 21 has a constant diameter equal on both sides of the diaphragm.

The hydraulic actuator housing unit is further composed of a shell 96, and the rear closure 12 of the pneumatic actuator 3. The shell 96 is formed with a cylindrical depression that faces the rear closure 12. The rear closure 12 has an external rear surface formed with an identical cylindrical depression the diameter of which is equal to the diameter of the cylindrical depression of the shell 96. The shell 96 and the rear closure 12 form the hydraulic actuator housing unit by being held together with fastener means (not shown).

The hydraulic actuator actuation means 21 is disposed and fixedly compressed between the shell 96 and the rear closure 12, and thus, seals the perimeter of the two incorporated cylindrical depressions of the shell 96 and of the rear closure 12, whereby the hydraulic actuator actuation means 21 divide the hydraulic chamber formed by the two cylindrical depressions into a first hydraulic chamber 48*a* and a second hydraulic chamber 48*b*.

The shell 96 is further formed with an axial hole through which air-tightly extends the rear end of the double rod 30.

The equal diameter of the rear closure's 12 and the shell's 96 cylindrical depressions together with the equal diameter of the double rod 30 on both sides of the hydraulic actuator actuation means 21, and a negligible small thickness of the hydraulic actuator actuation means 21 allow to obtain conditions of a hydraulic actuator with zero volumetric differential.

The rear closure 12 is further formed with a first segment of the dampening fluid path 24*h*, and an inlet 102 for filling the hydraulic chamber of the hydraulic actuator and all the adjacent hydraulic cavities with a suitable dampening fluid.

The shell 96 is further formed with a second segment of the dampening fluid path 24*h*.

The first and the second segments of the dampening fluid path 24*h* are connected through a dampening fluid flow governor means 27 built into the shell 96, and together form the dampening fluid flow path 24*h*. Per the sixth embodiment of the present invention the function of the dampening fluid flow governor means 27 is carried by a pneumatically controlled shut-off valve 63 and a permanent orifice 51 connected in series.

Both, the first hydraulic chamber 48*a* and the second hydraulic chamber 48*b* and all the adjacent hydraulic cavities are completely filled with dampening fluid and sealed with sealing means 105, which, per the sixth embodiment of the present invention, is an airtight threaded plug.

The front end of the double rod 30 air-tightly extends through the axial hole of the rear closure 12 of the pneumatic actuator 3. Further, the front end of the double rod 30 is fixedly connected to pneumatic actuator actuation means 15 to enable simultaneous linear displacements of pneumatic actuator actuation means 15 and hydraulic actuator actuation means 21. During actuation the pneumatic actuator actuation means 15 through the hydraulic actuator actuation means 21 effectively force transfer of the dampening fluid between the first and second hydraulic chambers 48*a* and 48*b,* and therefore, provide dampening of the pneumatic actuator.

FIGS. 7*a*–7*d* show isometric views of a rotary type hydropneumatic actuator according to the seventh embodiment of the present invention.

Figures 7A, 7B, 7C, 7D:
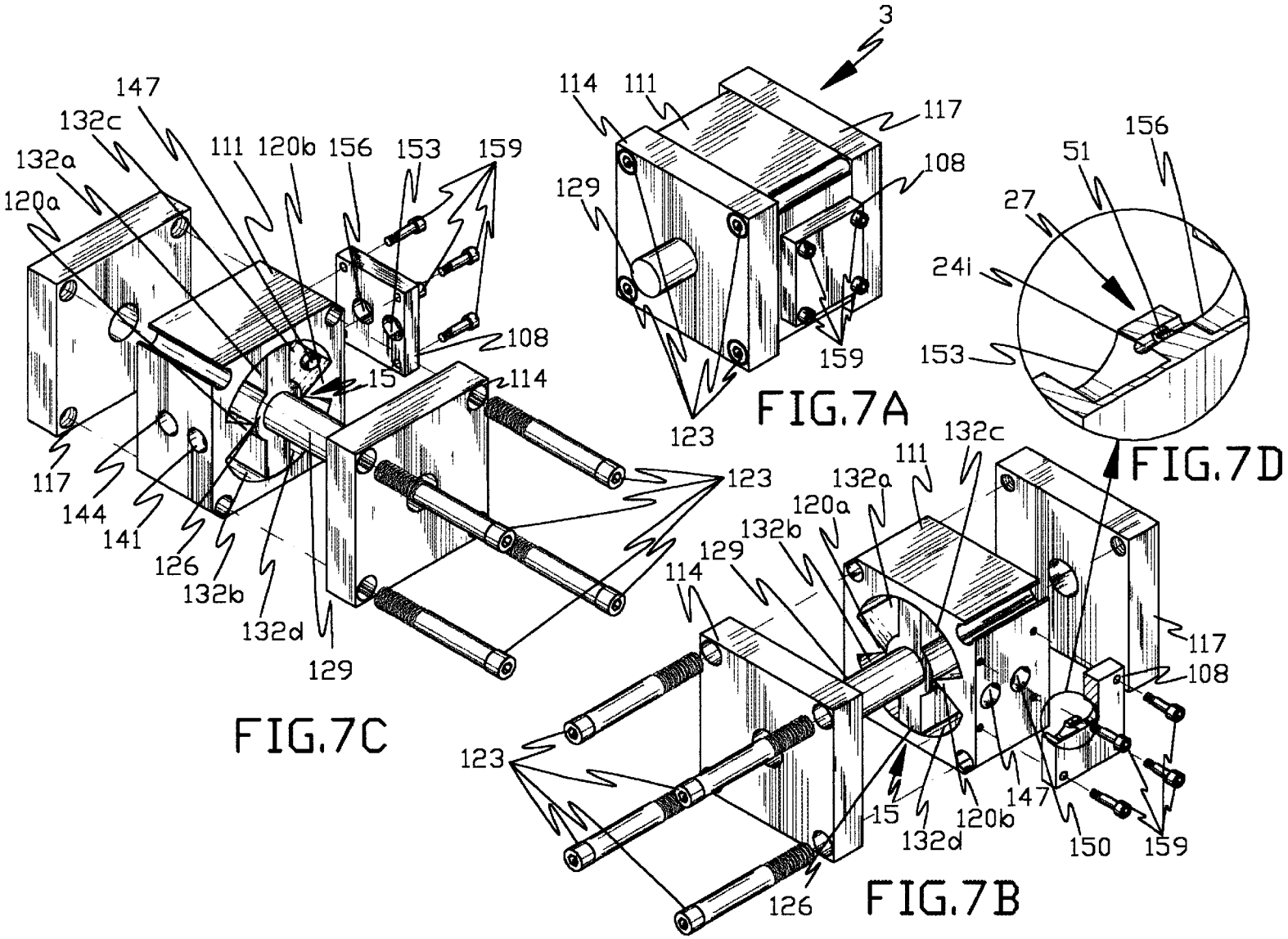
FIG. 7*a* shows an isometric view of a hydropneumatic actuator of a seventh embodiment according to the present invention.
FIG. 7*b* shows an isometric view of an exploded assembly with encircled broken-out section exposing the internal structure per the seventh embodiment of the present invention.
FIG. 7*c* is another isometric view of the same exploded assembly per the seventh embodiment of the present invention (shown from the side unexposed on FIGS. 7*a*–7*b*).
FIG. 7*d* shows a partial enlarged view (of the area encircled on FIG. 7*b*) of the seventh embodiment of the present invention.

The hydropneumatic actuator per the seventh embodiment of the present invention generally comprises a pneumatic actuator 3 (shown on FIG. 7*a*) a hydraulic actuator, a dampening fluid path 24*i* (shown on FIG. 7*b* and FIG. 7*d*), and a dampening fluid flow governor means 27 (shown on FIG. 7*b* and FIG. 7*d*).

The pneumatic actuator 3 is composed of a pneumatic actuator housing unit (which further comprises of a body 111, a front closure 114 and a rear closure 117), and a pneumatic actuator actuation means 15.

The body 111 is a formed parallelepiped with an internal axial through cut, which is shaped as a cylindrical hole with two inwardly propagated identical triangular ribs 120*a* and 120*b* (shown on FIG. 7*b* and FIG. 7*c*). The ribs 120*a* and 120*b* are positioned diametrically opposite to each other.

The front closure 114 is fixedly mounted at the front end of the body 111, and the rear closure 117 is fixedly mounted a t the r ear end of the body 111. Both, the front closure 114 and the rear closure 117 are assembled to the body 111 with four identical fastener means 123.

The pneumatic actuator actuation means 15 are formed of a rotor 126 (shown on FIG. 7*b* and FIG. 7*c*) with a shaft 129.

The rotor 126 is slidably disposed inside said axial through cut of the body 111 (so to allow rotational reciprocation of the rotor 126 inside the body 111), whereby the space inside the pneumatic actuator housing unit is divided by the rotor 126 and the two ribs 120*a* and 120*b* into chambers 132*a,* 132*b,* 132*c,* and 132*d* (shown on FIG. 7*b* and FIG. 7*c*). The chambers 132*a,* 132*b,* 132*c,* and 132*d* are slidably sealed from each other with sealing means (not shown). Types and design arrangements of the sealing means are not limited by the scope of this invention; for instance, they can be served by polymer gaskets, elastic fins, etc.

The body 111 is further formed with channels 141 and 144 (shown on FIG. 7*c*). Through the channels 141 and 144 compressed air can be provided to the chambers 132*b* and 132*a* respectively to power.

Thus, the body 111 with the channels 141 and 144, the front closure 114 and the rear closure 17, the four fastener means 123, and the rotor 126 with the shaft 129 form said pneumatic actuator 3 with two pneumatic working chambers 132*a* and 132*b*.

According to the seventh embodiment of the present invention, the described above housing unit of the pneumatic actuator 3 and the pneumatic actuator actuation means 15 simultaneously serve functions of a housing unit for the hydraulic actuator and a hydraulic actuator actuation means subsequently.

The hydraulic actuator of the seventh embodiment is composed of a hydraulic actuator housing unit (sheared with pneumatic actuator), and a pneumatic actuator actuation means 15 (sheared with pneumatic actuator as well).

The dampening fluid path 24*i* (shown on FIG. 7*b* and FIG. 7*d*) and the dampening fluid flow governor means 27 are assembled in a governor means block 108, which is formed with two ports: a port 153 and a port 156 (shown on FIG. 7*b,* FIG. 7*c* and FIG. 7*d*). The dampening fluid path 24*i* connects the ports 153 and 156 together through the governor means 27. The governor means block 108 is mounted onto the body 111 with four identical fastener means 159.

The body 111 is further formed with a channel 147 (shown on FIG. 7*b* and FIG. 7*c*) with the first end of the channel 147 connected to the chamber 132*c,* which is by essence a first hydraulic chamber, and the second end of the channel 147 connected to the port 153 of the governor means block 108, and a channel 150 (shown on FIG. 7*b*) with the first end of the channel 150 connected to the chamber 132*d,* which is by essence a second hydraulic chamber, and the second end of the channel 150 connected to the port 153 of the governor means block 108.

The body 111 is further formed with an inlet (not shown) for filling the chambers 132*c* and 132*d,* and all adjacent hydraulic cavities with a suitable dampening fluid. Thus, the chamber 132*c* carries the function of the first hydraulic chamber and the chamber 132*d* carries the function of the second hydraulic chamber. The first hydraulic chamber 132*c,* the second hydraulic chamber 132*d,* and all adjacent hydraulic cavities are completely filled with dampening fluid and sealed with sealing means (not shown).

The assembly of the body 111, formed with the channels 147 and 150, the front closure 114, the rear closure 117, the four fastener means 123, and the rotor 126, formed with the shaft 129, further composes said hydraulic actuator.

The design arrangement of the seventh embodiment, in which the rotor 126 and the axial through cut of the body 111 are of symmetrical geometry, allows to form a hydraulic actuator with zero volumetric differential in which the volume of dampening fluid displaced from one chamber (132*c* or 132*d*) is always equal to the volume of dampening fluid received by the opposite chamber (132*d* or 132*c*).

When compressed air is let into the channel 141 and further into the chamber 132*b* it causes rotor 126, which at this moment carries the function of pneumatic actuator actuation means, to rotate counterclockwise. And, respectively, when compressed air is let into the channel 144 and further into the chamber 132*a* it causes the rotor 126 to rotate clockwise. During the counterclockwise rotation the rotor 126 (which at the same time carries the function of hydraulic actuator actuation means) simultaneously causes dampening fluid transfer from the second hydraulic chamber 132*d* to the first hydraulic chamber 132*c*. During the clockwise rotation, the rotor 126 causes reverse direction transfer of dampening fluid.

During dampening fluid transfer between the hydraulic chambers 132*c* and 132*d* dampening fluid passes through the dampening fluid flow governor means 27*a,* whereby takes place dampening of the rapid speed changes and creeping that naturally occur in the pneumatically powered rotor 126.

The hydropneumatic actuators encompassed in all the above embodiments represent only one type design arrangement with which the novel concept of the present invention is utilized. This is a type of design arrangement in which any relative displacement of a pneumatic actuator housing unit with respect to a pneumatic actuator actuation means is directly translated into an equal relative displacement of a hydraulic actuator housing unit with respect to a hydraulic actuator actuation means.

FIGS. 8–11 show four different isometric views of a hydropneumatic actuator according to the eighth embodiment of the present invention.

In the hydropneumatic actuator of the to eighth embodiment the novel concept of the present invention is utilized in combination with such a design arrangement in which a displacement occurring in pneumatic actuator translated proportionally into a displacement of hydraulic actuator using mechanical transmission means.

Figure 11:
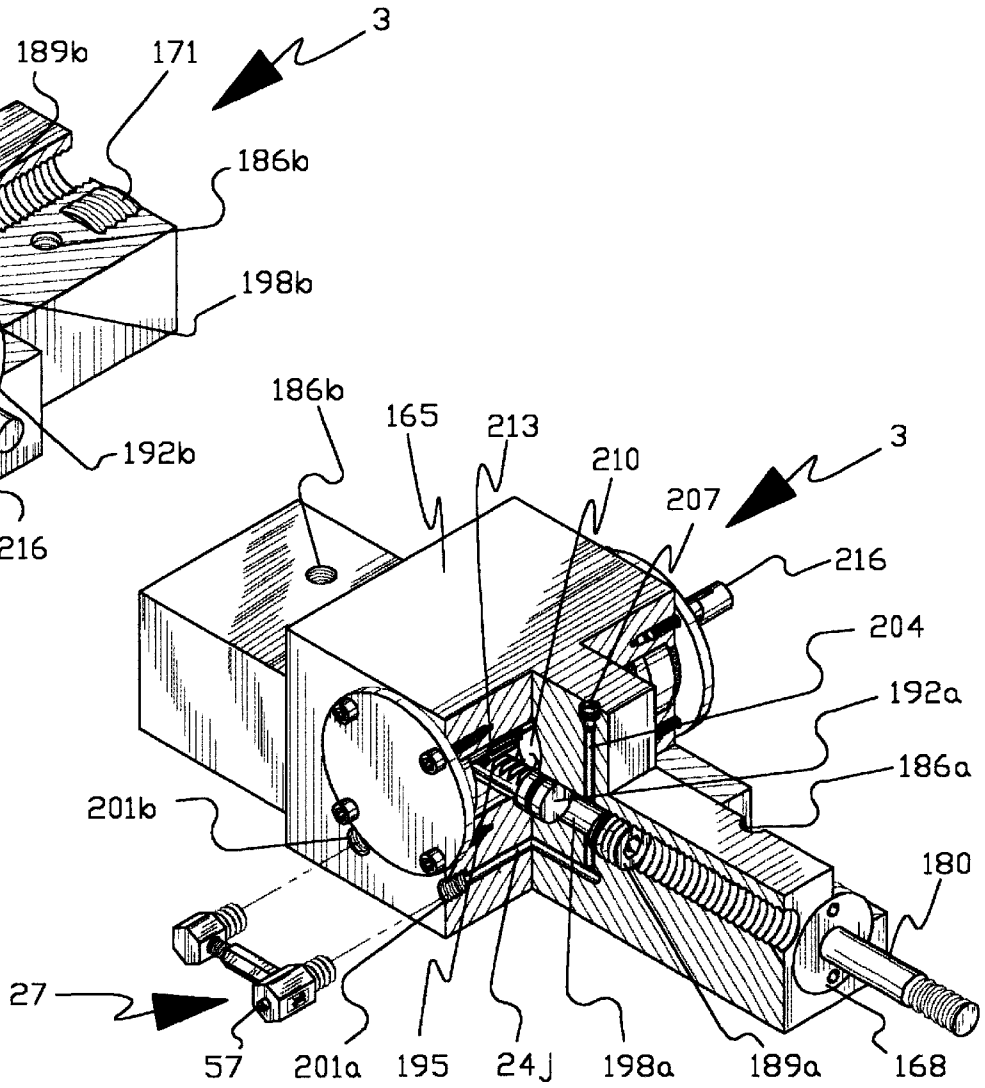
FIG. 11 is another isometric view of the same hydropneumatic actuator per the eighth embodiment of the present invention (shown with two broken-out sections of the housing unit to indicate the internal structure of the hydraulic channels and details hidden on FIGS. 9 and 10).

The hydropneumatic actuator per the eighth embodiment of this invention generally comprises a pneumatic actuator 3, a hydraulic actuator, a dampening fluid path 24*j* (partially shown on FIG. 11), and a dampening fluid flow governor means 27 (shown on FIG. 11). The pneumatic actuator 3, according to the eighth embodiment of this invention, is comprised of a pneumatic actuator housing unit and pneumatic actuator actuation means (shown on FIG. 9).

Figure 9:
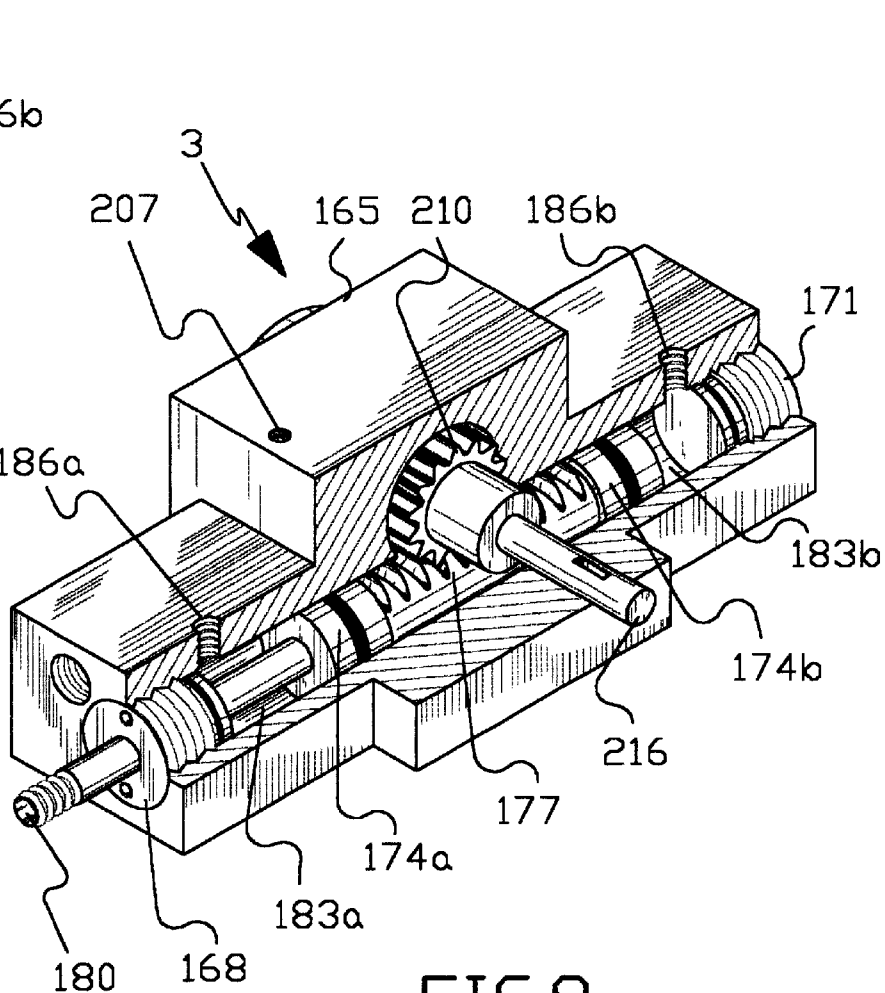
FIG. 9 is another isometric view of the same hydropneumatic actuator per the eighth embodiment of the present invention (shown without the front cover and with a broken-out section of the housing unit to indicate the internal structure of the pneumatic elements of the actuator).
Figure 8:
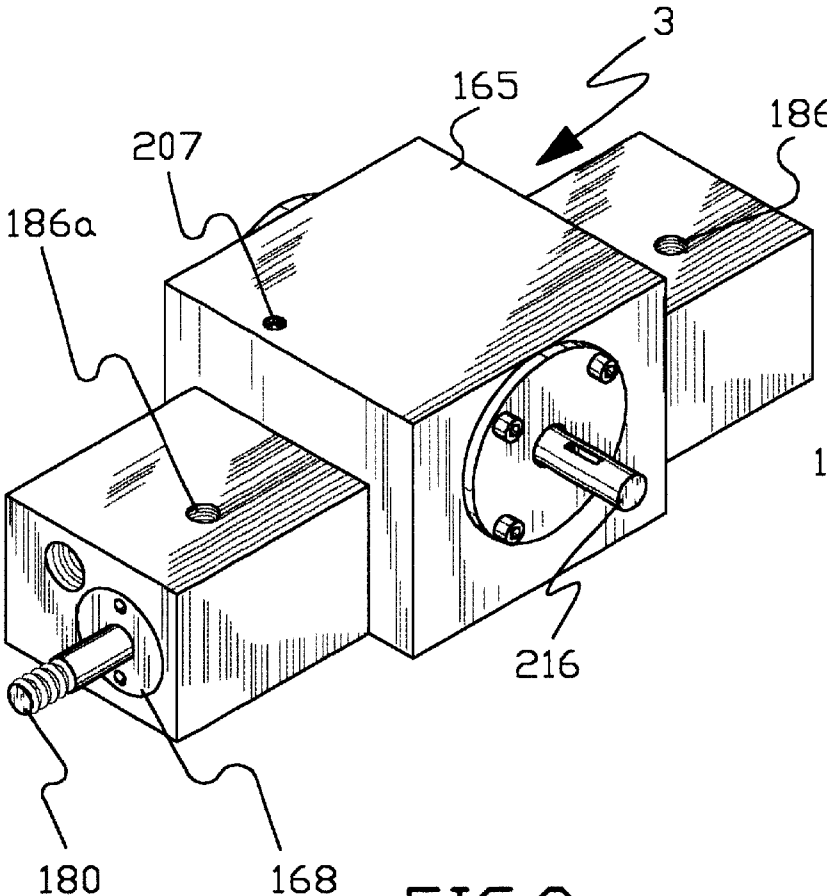
FIG. 8 is an isometric view of a hydropneumatic actuator of an eighth embodiment according to the present invention.
Figure 10:
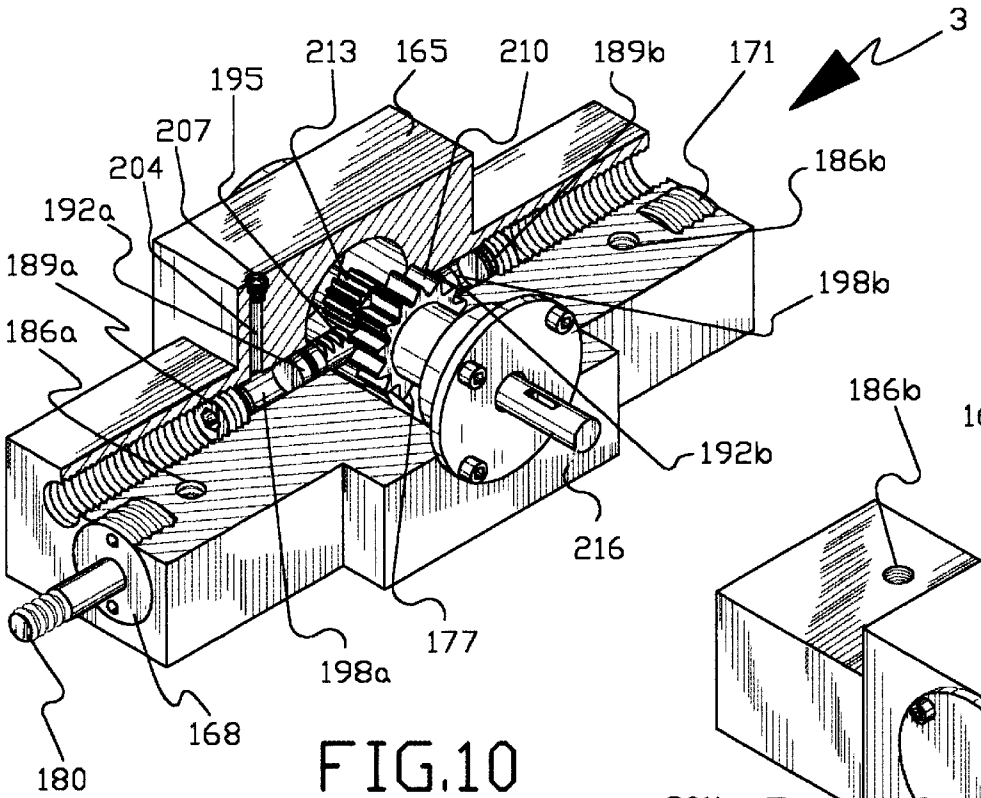
FIG. 10 is another isometric view of the same hydropneumatic actuator per the eighth embodiment of the present invention (shown with yet another broken-out section of the housing unit to indicate the internal structure of the hydraulic elements of the actuator).

The pneumatic actuator housing unit is further comprised of a body 165, a pneumatic front plug 168, a pneumatic rear plug 171 (shown on FIG. 9 and FIG. 10). The pneumatic actuator actuation means is further comprised of two pistons 174*a* and 174*b* fixedly connected through a gear rack 177 (shown on FIG. 9 and FIG. 10) positioned between them, and a rod 180.

As shown on FIG. 9, the body 165 is formed with a first cylindrical through bore threaded at both ends. The pneumatic actuator actuation means is slidably disposed inside said first cylindrical bore.

The pneumatic front plug 168 and the pneumatic rear plug 171 are air-tightly threaded into the threaded ends of the first bore, whereby two pneumatic chambers 183*a* and 183*b* are formed inside the pneumatic actuator housing unit.

The body 165 is further formed with channels 186*a* and 186*b*. Through the channel 186*a* compressed air can be provided to the chamber 183*a,* and through the channel 186*b* compressed air can be provided to the chamber 183*b* to actuate the pneumatic actuator actuation means.

The hydraulic actuator, according to the eighth embodiment of this invention, is comprised of a hydraulic actuator housing unit and a hydraulic actuator actuation means (shown on FIG. 10 and FIG. 11). The hydraulic actuator housing unit is further comprised of a body 165 (shared with pneumatic actuator), a hydraulic plug 189*a* (shown on FIG. 10 and FIG. 11), and a hydraulic plug 189*b* (shown on FIG. 10). The hydraulic actuator actuation means is further comprised of two identical pistons 192*a* and 192*b* fixedly connected through a gear rack 195 (shown on FIG. 10 and FIG. 11) positioned between them.

As shown on FIG. 10 and FIG. 11, the body 165 is further formed with a second cylindrical through bore threaded at both ends. The hydraulic actuator actuation means are slidably disposed inside said second cylindrical bore, and hydraulic plugs 189*a* and 189*b* are air-tightly threaded into the threaded ends of the second bore, whereby a first hydraulic chamber 198*a* and a second hydraulic chamber 198*b* are formed inside the hydraulic actuator housing unit.

The dampening fluid path 24*j* (partially shown on FIG. 11) comprises two symmetrical hydraulic channels formed in the body 165. The first hydraulic channel (shown on FIG. 11) connects the first hydraulic port 201*a* to the first hydraulic chamber 198*a*. The second hydraulic channel (not shown) connects the second hydraulic port 201*b* to the second hydraulic chamber 198*b*.

The first hydraulic port 201*a* and the second hydraulic port 201*b* are interconnected through the dampening fluid flow governor means 27 (shown on FIG. 11). Per the eighth embodiment of the present invention, the dampening fluid flow governor means 27 is an adjustable needle valve 57 that allows for fine adjustment to the rate of dampening fluid flow.

The body 165 is further formed with an inlet 204 (shown on FIG. 10 and FIG. 11) for filling the first and the second hydraulic chambers 198*a* and 198*b,* and all adjacent cavities with a suitable dampening fluid. The first hydraulic chamber 198*a,* second hydraulic chamber 198*b,* and all adjacent cavities are completely filled with dampening fluid and sealed with sealing means 207.

The design arrangement of the eighth embodiment of the present invention, in which the two pistons 192*a* and 192*b* have the same outer diameter and active displacement area, allows to form a hydraulic actuator with zero volumetric differential.

The function of the mechanical transmission means of the eighth embodiment of the present invention is carried by a rack-and gear drive (shown on FIGS. 9–11), which is composed of said gear rack 177, said gear rack 195, a gear wheel 210, a gear wheel 213, and a shaft 216 (on which both gearwheels 210 and 213 are fixedly mounted). The shaft 216 is supported in the body 165 (for example with two bushings).

The gear rack 177, being a solid of part of the pneumatic actuator actuation means, is mechanically coupled to the gear wheel 210 and further through the shaft 216 and the gear wheel 213 is mechanically coupled to the gear rack 195, which is a solid of part of the hydraulic actuator actuation means. Thus, the described chain provides translation of the pneumatic actuator actuation means displacement into the hydraulic actuator actuation means displacement at a constant ratio determined by the ratio of the mechanical transmission means used.

The main goal of mechanical transmission means utilization is to minimize the stroke of hydraulic actuator actuation means, dimensions of the required hydraulic actuator, and therefore, the overall dimensions of the hydropneumatic actuator according to this invention. The additional benefits of having the mechanical transmission means is the possibility of obtaining multiple forms of actuation by the same hydropneumatic actuator.

When compressed air is let into the channel 186*a* and further into the chamber 192*a,* or into the channel 186*b* and then into the chamber 192*b* it causes linear displacement of the pneumatic actuator actuation means. Further, through the gear rack 177 coupled to the gear wheel 210 the linear displacement of the pneumatic actuator actuation means is translated into rotary displacement of the shaft 216. From the shaft 216 through the gear wheel 213 and the gear rack 195 coupled to the gear wheel 213 the rotary displacement is further translated into linear displacement of the hydraulic actuator actuation means. The linear displacement of the is hydraulic actuator actuation means causes dampening fluid transfer between the hydraulic chambers 192*a* and 192*b* of the hydraulic actuator.

During dampening fluid transfer between the hydraulic chambers 192*a* and 192*b* dampening fluid passes through the dampening fluid flow governor means 27, whereby dampening of rapid speed changes and creeping naturally occurring in the pneumatic actuator takes place.

Figure 12B:
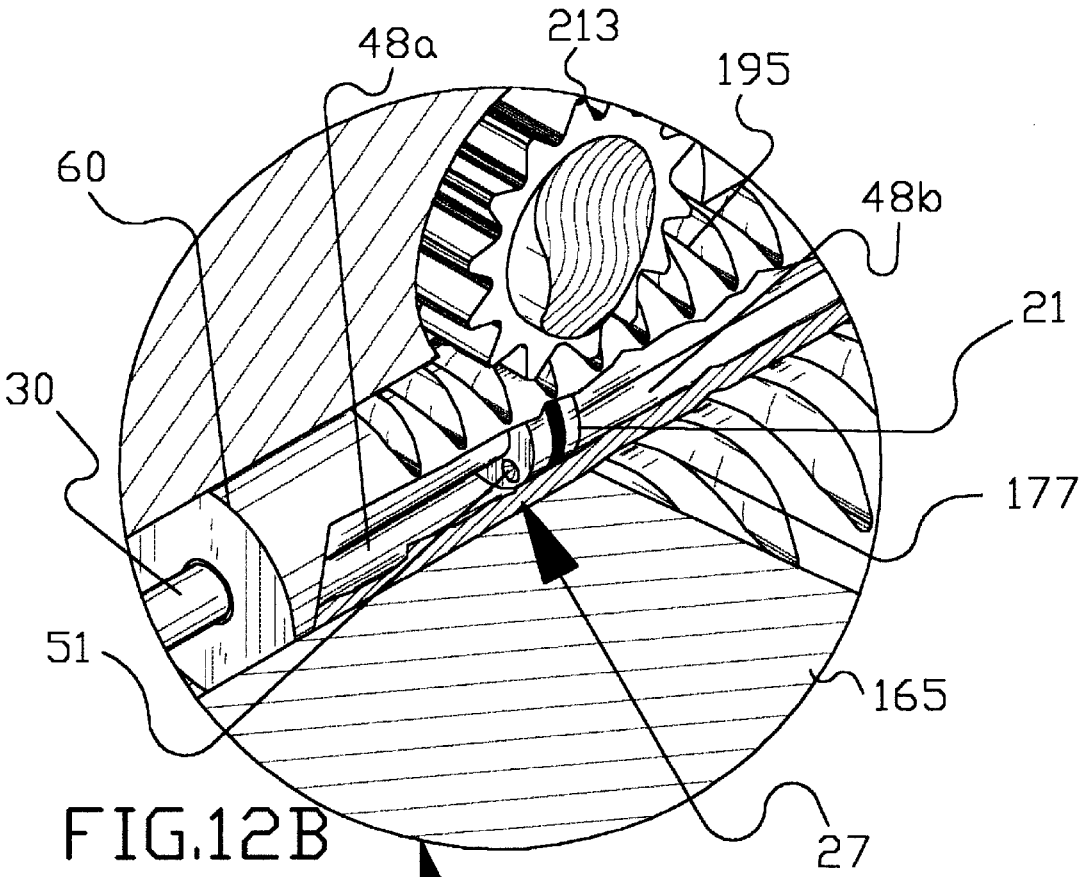
FIG. 12*b* shows a partial enlarged view (of the area encircled on FIG. 12*a*) of the ninth embodiment of the present invention.
Figure 12A:
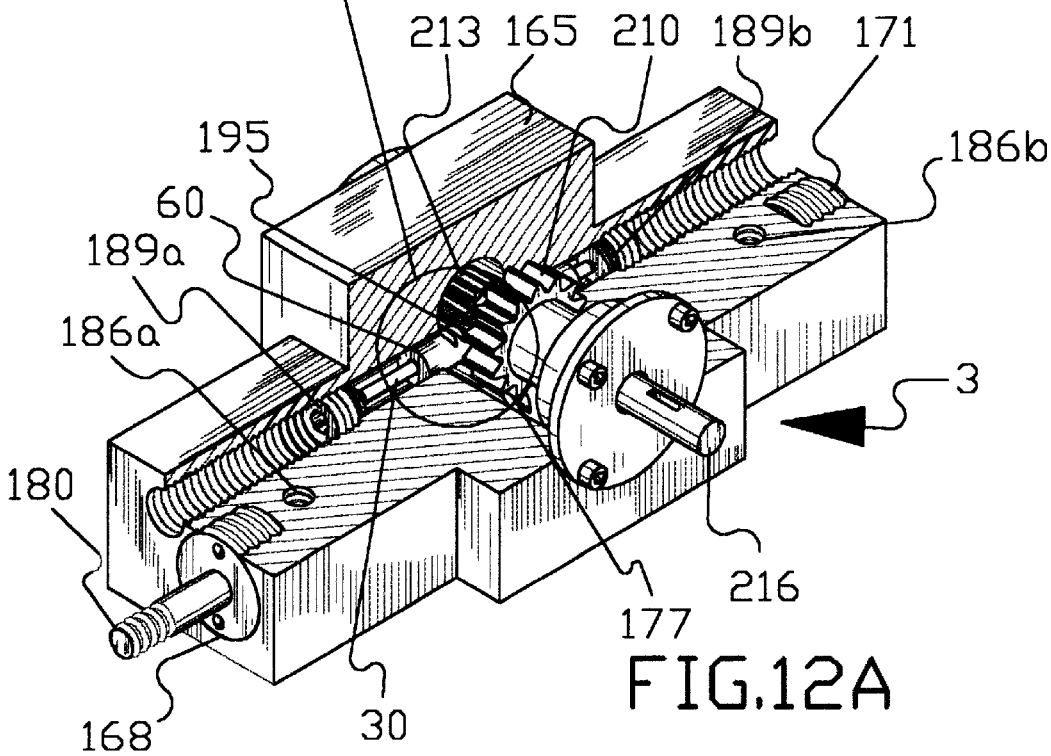
FIG. 12*a* is an isometric view of a hydropneumatic actuator of a ninth embodiment according to the present invention shown with a broken-out section of the housing unit, to indicate the internal structure of the hydraulic and mechanical elements of the actuator.

FIG. 12*a* and FIG. 12*b* show an isometric view of a hydropneumatic actuator according to the ninth embodiment of the present invention.

The design arrangement of the ninth embodiment is generally similar to the design arrangement of the eighth embodiment for which reason the part of the arrangement identical to the one described above is not show on FIG. 12*a* and FIG. 12*b*.

The hydropneumatic actuator per the ninth embodiment of this invention generally comprises a pneumatic actuator 3, a hydraulic actuator, and dampening fluid path and a dampening fluid flow governor means 27. The dampening fluid path of the ninth embodiment is combined with the dampening fluid flow governor means 27.

The pneumatic actuator 3, according to the ninth embodiment of this invention, is comprised of a pneumatic actuator housing unit and pneumatic actuator actuation means (not shown) identical to the pneumatic actuator actuation means of the eighth embodiment (shown on FIG. 9). The pneumatic actuator housing unit is further comprised of a body 165, a pneumatic front plug 168, and a pneumatic rear plug 171 identical to the pneumatic rear plug 171 of the eighth embodiment.

The pneumatic actuator actuation means is fixedly connected to a gear rack 177, which is further mechanically coupled to a gear wheel 210 and further through the shaft 216 and the gear wheel 213 mechanically coupled to the gear rack 195.

The hydraulic actuator of the ninth embodiment is composed of a hydraulic actuator housing unit and a hydraulic actuator actuation means 21 formed with a double rod 30. The hydraulic actuator housing unit is further comprised of a hollow cylindrical body 60 formed with the gear rack 195, and a rear closure (not shown) fixedly mounted at the rear end of the hollow cylindrical body 60. The hydraulic actuator actuation means 21 is slidably disposed inside the hollow cylindrical body 60 and divide the active volume of the hydraulic actuator housing unit into a first hydraulic chamber 48*a* and a second hydraulic chamber 48*b*.

The double rod 30 has the same diameter on both sides of the hydraulic actuator actuation means 21, therefore is a zero volumetric differential hydraulic actuator.

The front end and the rear end of the double rod 30 are fixedly clamped between a front closure and a rear closure of the hydraulic actuator (186*a* and 186*b* respectively) threaded into the body 165. Thus, the hydraulic actuator actuation means 21 remains fixedly joined with the pneumatic actuator housing unit described.

According to the ninth embodiment of the present invention, the function of the dampening fluid flow governor means 27 is carried by a permanent orifice 51 formed as a small diameter bore drilled through the hydraulic actuator actuation means 21. Simultaneously the permanent orifice 51 serves the function of the dampening fluid path allowing the dampening fluid to communicate between the two hydraulic chambers 48*a* and 48*b*.

The body 165 is further formed with channels 186*a* and 186*b*. Through the channels 186*a* and 186*b* compressed air can be provided to actuate the pneumatic actuator actuation means.

The hollow cylindrical body 60 is formed with an inlet (not shown) for filling the first and the second hydraulic chambers 48*a* and 48*b*, and all adjacent cavities with a suitable dampening fluid. The first hydraulic chamber 48*a*, second hydraulic chamber 48*b*, and all adjacent cavities are completely filled with dampening fluid and sealed with sealing means (not shown).

The pneumatic actuator actuation means of the ninth embodiment is mechanically coupled with the hydraulic actuator housing unit. The function of the mechanical transmission means of the ninth embodiment of the present invention is carried by a rack-and gear drive composed of the gear rack 177, said gear rack 195, a gear wheel 210, a gear wheel 213, and a shaft 216 (on which both gear wheels 210 and 213 are fixedly mounted). The shaft 216 is supported in the housing unit 165 (for example with two bushings).

When compressed air is let into the channel 186*a* with simultaneous exhaust provided from the channel 186*b*, or into the channel 186*b* with simultaneous exhaust provided from the channel 186*a*, it causes linear displacement of the pneumatic actuator actuation means fixedly attached to the gear rack 177. Further, the linear displacement of the gear rack 177 is being translated into rotary displacement of the gear wheel 210 mechanically coupled with the gear rack 177. The rotary displacement of the gear wheel 210 is further being translated into rotary displacement of the shaft 216, and yet further from the shaft 216 through the gear wheel 213 into linear displacement of the gear rack 195 coupled to the gear wheel 213.

This linear displacement of the gear rack 195 and, therefore, of the hydraulic actuator housing unit occuring with respect to the hydraulic actuator actuation means causes dampening fluid transfer between the hydraulic chambers 48*a* and 48*b* of the hydraulic actuator.

During dampening fluid transfer between the hydraulic chambers 48*a* and 48*b* dampening fluid passes through the dampening fluid flow governor means 27, whereby dampening of rapid speed changes and creeping takes place.

Naturally, the design arrangement of the ninth embodiment as well as all of the above embodiments is not intended to limit the present invention. For example, different types of lever motion mechanisms for instance such as cam-shaft mechanisms, etc. could be optionally utilized for mechanical transmission means. The shaft 216 such as shown on FIGS. 8, 9, 10, 11, 12*a* and 12*b* of the eighth and ninth embodiments could be fixedly connected to a rotor of a dampening rotary hydraulic actuator with zero volumetric differential.

Naturally, the above instances should not be construed as limitations on the scope of this invention. The devices such as permanent orifices, needle valves, as well as any other types of valves with different types of control, and different varieties of combinations of such devices could be optionally utilized for the dampening fluid flow governor means depending on technical specifications for particular applications.

The hydropneumatic actuator according to the present invention can be also equipped with different types of transducers (linear displacement transducers for determining position of the pneumatic actuator actuation means and forming positional feedback, speed transducers, acceleration transducers, load transducer, etc.) and combinations of them. Many other elements of the hydropneumatic actuator according to the present invention in relation with specifics applications will be obvious to those skilled in the art.

Therefore, the forgoing is considered as illustrative only of the principles of the present invention, and, since numerous modifications will readily occur to those skilled in the art, it is not desired to limit the invention to the exact construction and operation shown and described.

What is claimed is:

1. A hydropneumatic actuator for producing pneumatically powered linear displacement a. a pneumatic actuator for producing pneumatically powered liner displacement comprising a stationary hollow pneumatic actuator housing unit and at least one pneumatic actuator actuation means movably disposed inside said pneumatic actuator housing unit, said pneumatic actuator housing unit being formed with at least two channels whereby pneumatic energy is provided to said pneumatic actuator actuation means, b. at least one positive-displacement linear hydraulic actuator with "zero volumetric differential" disposed inside said pneumatic actuator and coupled with said pneumatic actuator so to enable transfer of displacement generated by said pneumatic actuator into displacement of said linear hydraulic actuator, said linear hydraulic actuator is comprised of at least one hollow hydraulic actuator housing unit and at least one hydraulic actuator actuation means moveably disposed within said hydraulic actuator housing unit and thereby forming at least one first hydraulic chamber and at least one second hydraulic chamber with both said chambers being completely filled with dampening fluid and permanently sealed to self-contain said dampening fluid, said linear hydraulic actuator is utilized for transforming linear displacement generated by said pneumatic actuator into positive displacement of dampening fluid, said "zero volumetric differential" is achieved by said first hydraulic chamber and said second hydraulic chamber having ratios of volumetric changes to linear displacement of said hydraulic actuator actuation means equals, c. at least one dampening fluid path for connecting said first hydraulic chamber and said second hydraulic chamber, said dampening fluid path is being completely filled with dampening fluid, and d. at least one dampening fluid flow governor means for controlling flow rate of dampening fluid transfer through said dampening fluid path between said first hydraulic chamber and said second hydraulic chamber, said dampening fluid flow governor means is disposed seperate from said hydraulic actuator actuation means, whereby pneumatically powered actuation of said pneumatic actuator will be provided with incompressible, hydraulically governed dampening and positioning.

2. The hydropneumatic actuator of claim 1 wherein said hydraulic actuator actuation means is comprised of at least one cylindrical piston.

3. The hydropneumatic actuator of claim 1 wherein said hydraulic actuator actuation means comprised of at one flexible diphragm with a double rod.

4. The hydropneumatic actuator of claim 1 wherein said dampening fluid flow governor means is comprised of at least one permanent orifice.

5. The hydropneumatic actuator of claim 1 wherein said dampening fluid flow governor means is comprised of at least one valve means.

6. The hydropneumatic actuator of claim 1 wherein said dampening fluid flow governor means is comprised of a combination of at least one permanent orifice means and at least one valve means.

7. The hydropneumatic actuator of claim 1 wherein said hydraulic actuator actuation means is comprised of at least one first bellows means with inner space forming said first hydraulic chamber and at least one second bellows means with inner space forming said second hydraulic chamber, wherein said first bellows means having a predetermined volumetric to linear displacement ratio equal to a volumetric to linear displacement ratio of said second bellows means.

* * * * *